US008172345B2

(12) United States Patent
Liang et al.

(10) Patent No.: US 8,172,345 B2
(45) Date of Patent: May 8, 2012

(54) SELF-MOVING DEVICE FOR MOVABLE FURNITURE PARTS

(75) Inventors: Hsiu-Chiang Liang, Kaohsiung Hsien (TW); Ken-Ching Chen, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 202 days.

(21) Appl. No.: 12/505,791

(22) Filed: Jul. 20, 2009

(65) Prior Publication Data

US 2011/0012488 A1 Jan. 20, 2011

(51) Int. Cl.
*A47B 88/00* (2006.01)

(52) U.S. Cl. ..... 312/333; 312/334.46

(58) Field of Classification Search ..... 312/319.1, 312/333, 330.1, 334.44, 334.46, 334.1, 334.6, 312/334.27, 334.31, 334.32
See application file for complete search history.

(56) References Cited

U.S. PATENT DOCUMENTS

| | | | | |
|---|---|---|---|---|
| 3,376,088 | A * | 4/1968 | Bol et al. | 292/353 |
| 4,912,727 | A * | 3/1990 | Schubert | 312/334.8 |
| 5,040,833 | A | 8/1991 | Brunnert | |
| 5,474,375 | A * | 12/1995 | Hollenstein et al. | 312/319.1 |
| 6,736,471 | B2 * | 5/2004 | Lin | 312/333 |
| 6,953,233 | B2 * | 10/2005 | Lam et al. | 312/333 |
| 6,979,066 | B2 * | 12/2005 | Yang | 312/333 |
| 6,997,528 | B2 * | 2/2006 | Yang | 312/333 |
| 7,040,725 | B1 * | 5/2006 | Mao-Chin | 312/334.44 |
| 7,083,243 | B2 * | 8/2006 | Lee | 312/333 |
| 7,249,813 | B2 * | 7/2007 | Gasser | 312/333 |
| 7,347,515 | B1 * | 3/2008 | Lu | 312/333 |
| 7,374,260 | B2 * | 5/2008 | Lu | 312/333 |
| 7,374,261 | B1 | 5/2008 | Wang | |
| 7,413,270 | B2 | 8/2008 | Chang et al. | |
| 7,472,973 | B2 * | 1/2009 | Huang | 312/333 |
| 7,537,296 | B2 | 5/2009 | Leon et al. | |
| 7,802,856 | B2 * | 9/2010 | Hashemi et al. | 312/334.46 |
| 7,854,485 | B2 * | 12/2010 | Berger | 312/333 |
| 2004/0183411 | A1 * | 9/2004 | Boks | 312/333 |
| 2006/0043851 | A1 * | 3/2006 | Lee | 312/333 |
| 2007/0090735 | A1 * | 4/2007 | Hashemi et al. | 312/334.46 |
| 2007/0103041 | A1 * | 5/2007 | Kropf et al. | 312/333 |
| 2009/0026902 | A1 * | 1/2009 | Jurja | 312/319.1 |
| 2009/0278430 | A1 * | 11/2009 | Liang et al. | 312/319.1 |
| 2011/0129172 | A1 * | 6/2011 | Liang et al. | 384/22 |

FOREIGN PATENT DOCUMENTS

| | | | |
|---|---|---|---|
| EP | 0743032 | B1 | 11/1996 |
| WO | WO 2006066774 | A1 * | 6/2006 |
| WO | WO 2008139299 | A1 * | 11/2008 |

* cited by examiner

*Primary Examiner* — Darnell M Jayne
*Assistant Examiner* — Kimberley S Wright
(74) *Attorney, Agent, or Firm* — Rosenberg, Klein & Lee

(57) ABSTRACT

A self-moving device for movable furniture parts includes a movable part which is movable with respect to a stationary part. The movable part includes first and second connecting portions. A closing mechanism includes a slide base which is movable in response to a force generated by a first elastic member. A locking member connected to the slide base is adapted to engage with the first connecting portion so that the movable part is urged by the first elastic member to be self-closing with respect to the stationary part. An opening mechanism includes a push member urged by a second elastic member to act on the second connecting portion. The movable part may be pushed by an external force to disengage the locking member from the first connecting portion so that the movable part is urged by the second elastic member to be self-opening with respect to the stationary part.

19 Claims, 21 Drawing Sheets

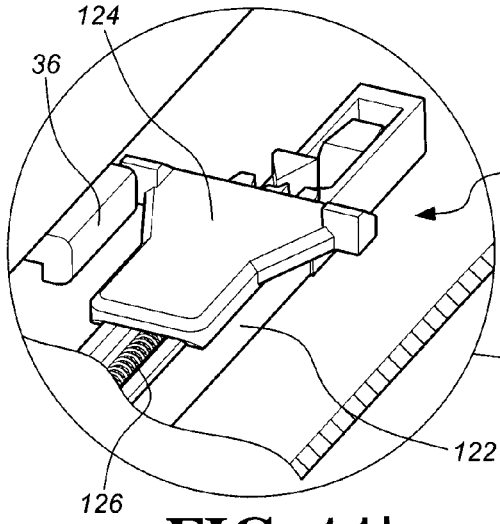
FIG. 11b
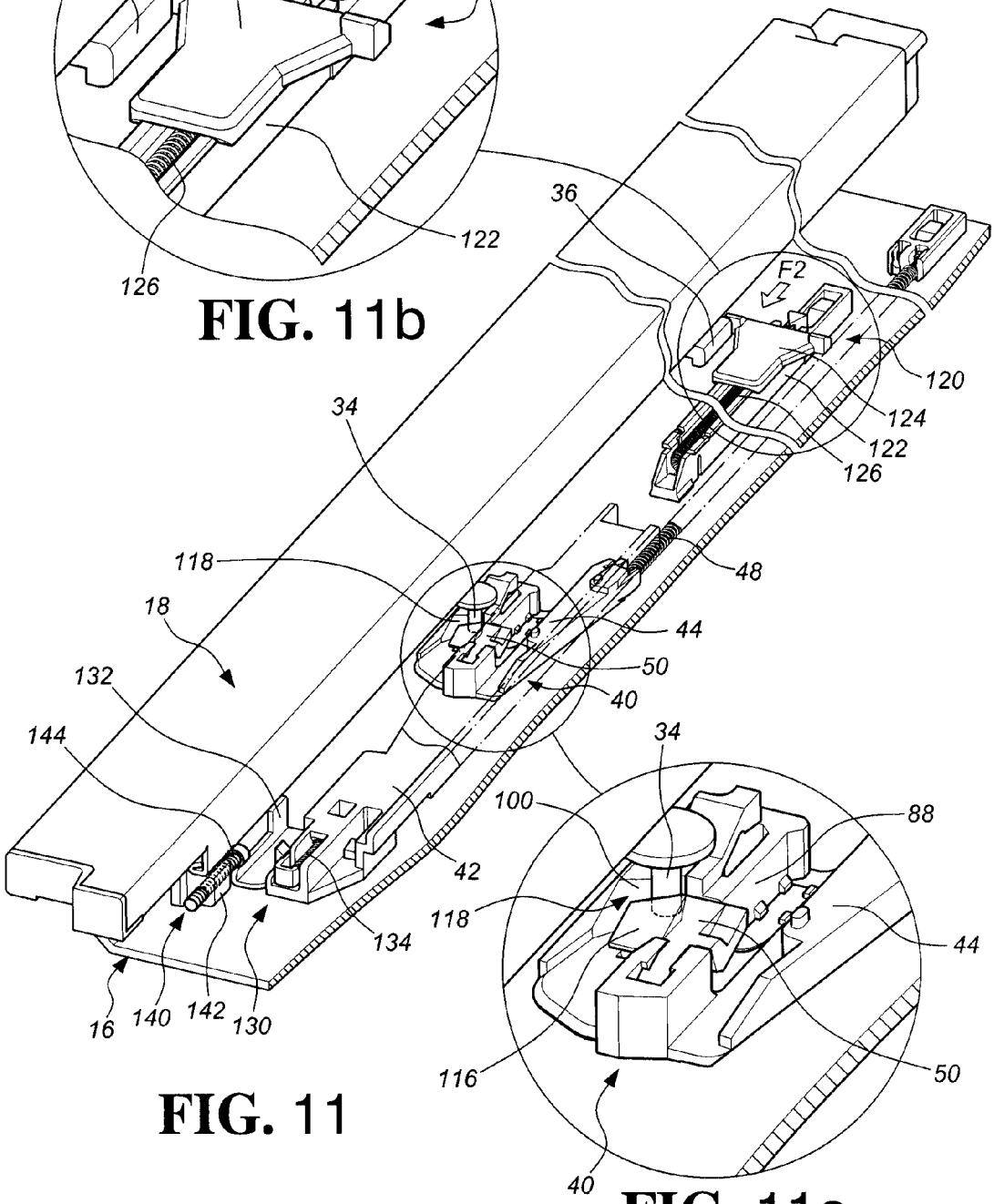
FIG. 11
FIG. 11a

SELF-MOVING DEVICE FOR MOVABLE FURNITURE PARTS

BACKGROUND OF THE INVENTION

1. Field of the Invention

The present invention relates to a self-moving device for movable furniture parts, in particular to a device that is self-closing and self-opening to control a movable part of a piece of furniture.

2. Description of the Prior Art

There are quite a few drawers having a self-opening function, which uses a restoring force to push a drawer in an open status when the drawer is released from its retaining situation. This device is designed only for opening the drawer, such as U.S. Pat. No. 5,040,833 to Brunnert, titled "Closing Device for Drawers"; U.S. Pat. No. 7,347,515 to Lu, titled "Sliding Rail Assembly Auto Opening Mechanism for Drawer"; U.S. Pat. No. 7,374,261 to Wang, titled "Push-Open Type Slide Structure"; U.S. Pat. No. 7,413,270 to Chang et al., titled "Locking Device of Sliding Drawer; and European Patent No. EP 0743032 B1 titled "Drawer Slide".

Another device is designed only for closing the drawer, such as U.S. Pat. No. 7,537,296 to Leon et al., titled "Dampened Movement Mechanism and Slide Incorporating the Same", which discloses an elastic force urging the drawer to a closed position and discloses a buffering technique.

However, all of the prior arts mentioned above, either self-closing or self-opening design is independent from each other. Therefore, it is necessary to install two devices for a drawer to be self-opening and self-closing, which increases the cost of assembly. In addition, it is not convenient for the end user to adjust the two different devices. So far, there is not a drawer or a slide assembly having both self-opening and self-closing functions.

SUMMARY OF THE INVENTION

The present invention relates to a self-moving device for movable furniture parts, which is applied to a movable part of a piece of furniture for providing self-closing and self-opening functions.

According to the present invention, there is provided a self-moving device for movable furniture parts, comprising:

a stationary part;

a movable part longitudinally slidable with respect to the stationary part and comprising a first connecting portion and a second connecting portion;

a closing mechanism comprising a guiding member fixed on the stationary part, the guiding member comprising a first longitudinal portion and a transverse portion, the first longitudinal portion having a first end and a second end opposing to the first end, the transverse portion extending from the first end of the first longitudinal portion; a slide base connected to the first longitudinal portion; a first elastic member connected to the slide base; a locking member connected to the slide base, the slide base being urged by the first elastic member to move towards the second end of the first longitudinal member of the guiding member for the locking member to engage with the first connecting portion of the movable part; and a stop portion corresponding to the locking member for the locking member to lean on the stop portion to move, and an opening mechanism comprising a second elastic member disposed on the stationary part and a push member urged by the second elastic member to move;

wherein when the movable part is retracted to a predetermined position with respect to the stationary part, the first connecting portion of the movable part engages with the locking member and the first connecting portion urged by the first elastic member forces the movable part to be self-closing towards the stationary part;

wherein the locking member is movable in response to an external force to lean on the stop portion such that the first connecting portion of the movable part disengages from the locking member, and the movable part is urged by the second elastic member and pushed by the push member to be self-opening.

Preferably, the self-moving device for movable furniture parts further comprises an elastic piece disposed between the locking member and the slide base.

Preferably, the self-moving device for movable furniture parts further comprises a retaining mechanism, the retaining mechanism comprising a retaining member connected to the guiding member and a retaining spring connected between the retaining member and the guiding member, the retaining member being urged by the retaining spring to move longitudinally with respect to the movable part.

Preferably, the self-moving device for movable furniture parts further comprises an adjusting mechanism, the adjusting mechanism comprising a base fixed to the movable part and an adjusting member movably connected to the base, the adjusting member engaging with the retaining member.

Preferably, the guiding member comprises a board portion; a first supporting portion and a second supporting portion disposed at two ends of the board portion to be connected with the stationary part, the first longitudinal portion being disposed between the first supporting portion and the second supporting portion to be connected with the slide base; a second longitudinal portion and a fourth longitudinal portion disposed at two sides of the first longitudinal portion; and a third longitudinal portion disposed in the second longitudinal portion, the first longitudinal portion and the transverse portion being defined by an L-shaped groove, the second longitudinal portion being defined by a longitudinal slot, the third longitudinal portion being defined by a longitudinal groove, the fourth longitudinal portion being defined by a longitudinal wall, the stop portion being disposed at one side of the fourth longitudinal portion.

Preferably, the stop portion has a guiding surface to guide movement of the locking member.

Preferably, the slide base comprises a first portion, a second portion, a third portion, and a body connected to the first portion, the second portion, and the third portion, the first portion comprising a first sliding portion, a second sliding portion, and a third sliding portion which are connected to the first longitudinal portion, the second longitudinal portion, and the third longitudinal portion, respectively, the first sliding portion being a protuberance, the second sliding portion being a bulge, the third sliding portion being a protuberance.

Alternatively, the slide base comprises a first portion, a second portion, a third portion, and a body connected to the first portion, the second portion, and the third portion, the first portion, the second portion and the body defining a channel, the third portion comprising a first wall, a second wall, and a coupling portion disposed between the first wall and the second wall, the coupling portion extending upwardly and obliquely from the third portion to form an inclined plane thereon, the first wall being adapted to engage with the first connecting portion, the coupling portion being adapted to engage with the second connecting portion.

Preferably, the self-moving device for movable furniture parts further comprises a coupling member having a spring room therein and a third elastic member disposed in the spring room, the coupling member urged by the third elastic member being movable, the coupling member having an inclined plane at an upper end thereof, the coupling member being adapted to engage with the second connecting portion.

Preferably, the self-moving device for movable furniture parts further comprises a buffer member, the buffer member comprising a buffer cylinder and a telescopic rod capable of moving with respect to the buffer cylinder, the telescopic rod extending outwards from the buffer cylinder to engage with the slide base.

It is the primary object of the present invention to provide a self-moving device for movable furniture parts, which has an integrity and common of the parts and is cost-effective for assembly.

It is another object of the present invention to provide a self-moving device for movable furniture parts, which is not necessary for the user to adjust a closing device and an open device, separately.

BRIEF DESCRIPTION OF THE DRAWINGS

FIG. 11 is a perspective view showing the configuration of the self-moving device and the slide assembly according to the first preferred embodiment of the present invention;

FIG. 11*a* is an enlarged view of a portion of the FIG. 11;

FIG. 11*b* is an enlarged view of an another portion of the FIG. 11;

DETAILED DESCRIPTION OF THE PREFERRED EMBODIMENTS

Figure 1:
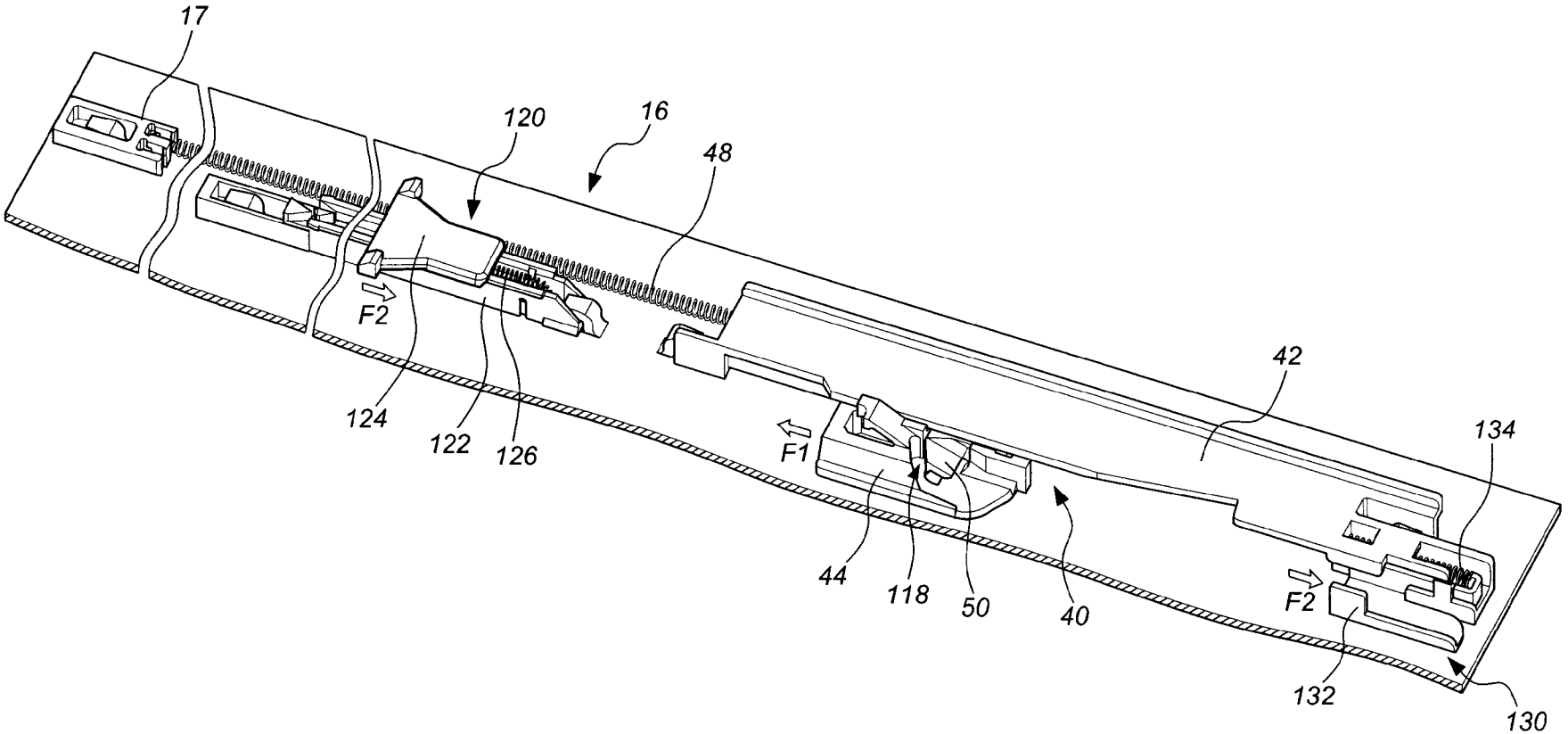
FIG. 1 is a perspective view showing a self-moving device mounted on a stationary part according to a first preferred embodiment of the present invention.

A self-moving device for movable furniture parts of the present invention, as shown in FIG. 1, comprises a stationary part 16 which may a part of a cabinet or a stationary rail of a slide assembly. In this embodiment, the present invention comprises a closing mechanism 40 mounted on the stationary part 16. The closing mechanism 40 comprises a guiding member 42 fixed on the stationary part 16, a slide base 44 movably connected to the guiding member 42, and a first elastic member 48 disposed on the stationary part 16. The first elastic member 48 is connected between the slide base 44 and the stationary part 16. The first elastic member 48 provides an elastic force to act on the slide base 44. In a preferred embodiment, a connecting seat 17 is fixed on the stationary part 16 and connected with the first elastic member 48 so as to keep the slide base 44 to move towards a first direction F1 constantly. A locking member 50 is connected to the slide base 44 and located between the slide base 44 and the guiding member 42. An opening mechanism 120 comprises a fixed portion 122 fixed on the stationary part 16, a push member 124 longitudinally movable in the fixed portion 122, and a second elastic member 126 disposed on the stationary part 16. The second elastic member 126 is connected between the fixed portion 122 and the push member 124 and provides an elastic force to the push member 124 to move towards a second direction F2 constantly. The second elastic member 126 has less elastic force than the first elastic member 48. A retaining mechanism 130 comprises a retaining member 132 longitudinally movable in the guiding member 42 and a retaining spring 134 connected between the guiding member 42 and the retaining member 132. The retaining member 132 is urged by the retaining spring 134 to move towards the second direction F2 constantly.

Figure 2:
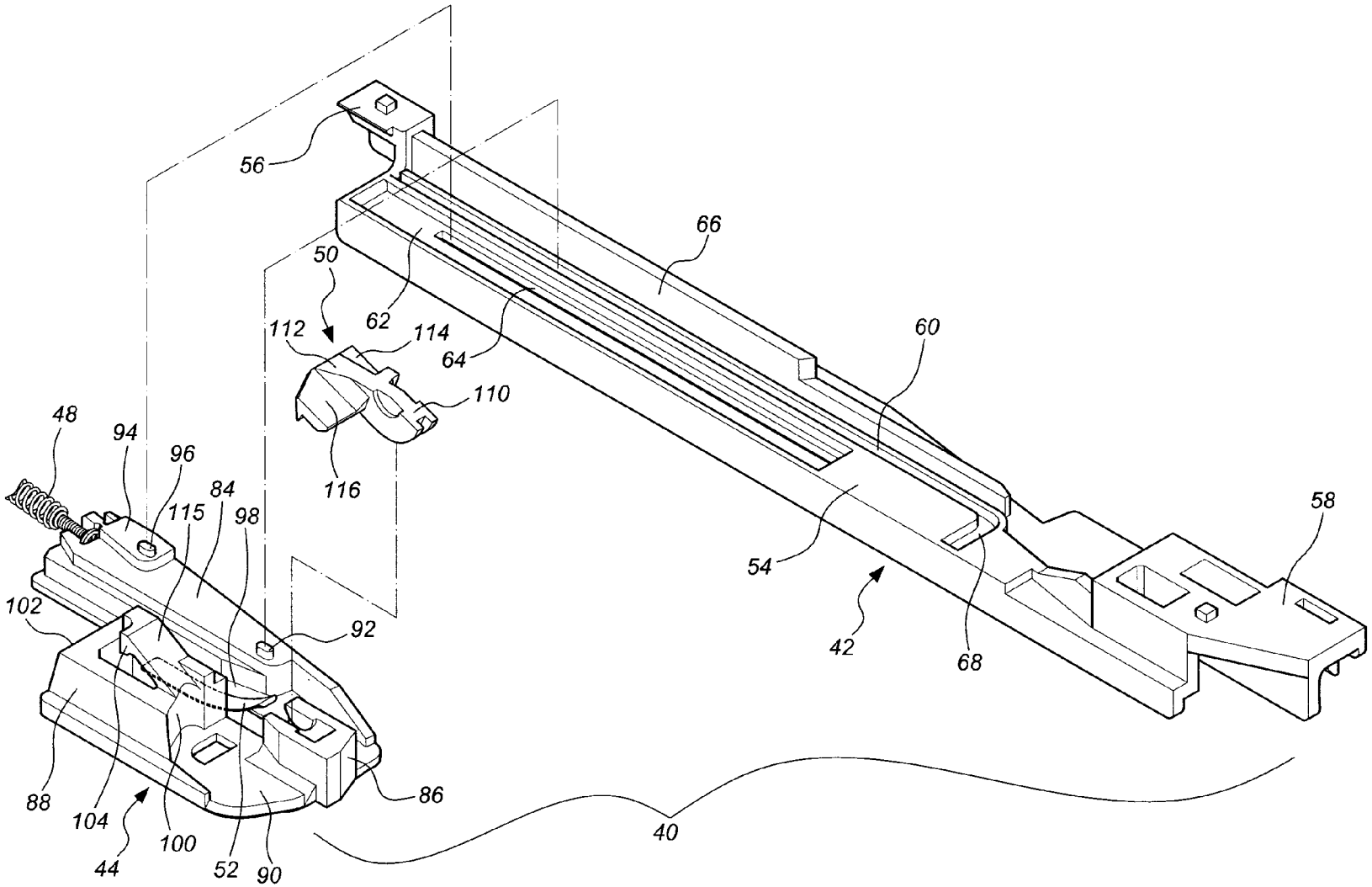
FIG. 2 is an exploded view showing a closing mechanism according to the first preferred embodiment of the present invention.

FIG. 2 shows an exploded view of the closing mechanism 40 which comprises the guiding member 42. The slide base 44 is movably connected to the guiding member 42. The first elastic member 48 is connected to the slide base 44. The locking member 50 is connected to the slide base 44. An elastic piece 52 is provided between the slide base 44 and the locking member 50.

The guiding member 42 comprises a board portion 54, a first supporting portion 56 and a second supporting portion 58 disposed at two ends of the board portion 54 to secure the board portion 54 to the stationary part 16. The first supporting portion 56 and the second supporting portion 58 define a space therebetween. A first longitudinal portion 60 is formed between the first supporting portion 56 and the second supporting portion 58. Preferably, the first longitudinal portion 60 is integrally formed with the guiding member 42. A second longitudinal portion 62 and a fourth longitudinal portion 66 are formed at two sides of the first longitudinal portion 60, respectively. A third longitudinal portion 64 is formed in the second longitudinal portion 62. In this embodiment, the first longitudinal portion 60 has a first end and a second end opposing to the first end. A transverse portion 68 extends from the first end of the first longitudinal portion 60. In a preferred embodiment, the first longitudinal portion 60 and the transverse portion 68 are defined by an L-shaped groove. The second longitudinal portion 62 is defined by a longitudinal slot. The third longitudinal portion 64 is defined by a longitudinal groove. The fourth longitudinal portion 66 is defined by a longitudinal wall.

The slide base 44 comprises a first portion 84, a second portion 86, a third portion 88, and a body 90 connected to the first portion 84, the second portion 86, and the third portion 88. The first portion 84 comprises a first sliding portion 92, a second portion 94, and a third portion 96 which are connected to the first longitudinal portion 60, the second longitudinal portion 62 and the third longitudinal portion 64, respectively. Preferably, the first sliding portion 92 is a protuberance which is slidably connected to the first longitudinal portion 60 and the transverse portion 68 of the guiding member 42. The second sliding portion 94 is a bulge which is slidably connected to the second longitudinal portion 62 of the guiding member 42. The third sliding portion 96 is a protuberance which is slidably connected to the third longitudinal portion 64 of the guiding member 42. Furthermore, a channel 98 is defined among the first portion 84, the second portion 86, and the body 90. The slide base 44 is straddled on the fourth longitudinal portion 66 of the guiding member 42 with the channel 98. According to the aforesaid configuration, the slide base 44 is linked to slide along the first longitudinal portion 60 and the transverse portion 68 of the guiding member 42 smoothly. The third portion 88 comprises a first wall 100, a second wall 102, and an elastic coupling portion 104 disposed between the first wall 100 and the second wall 102. The coupling portion 104 extends upwardly and obliquely from the third portion 88 to form an inclined plane 115.

Figure 3:
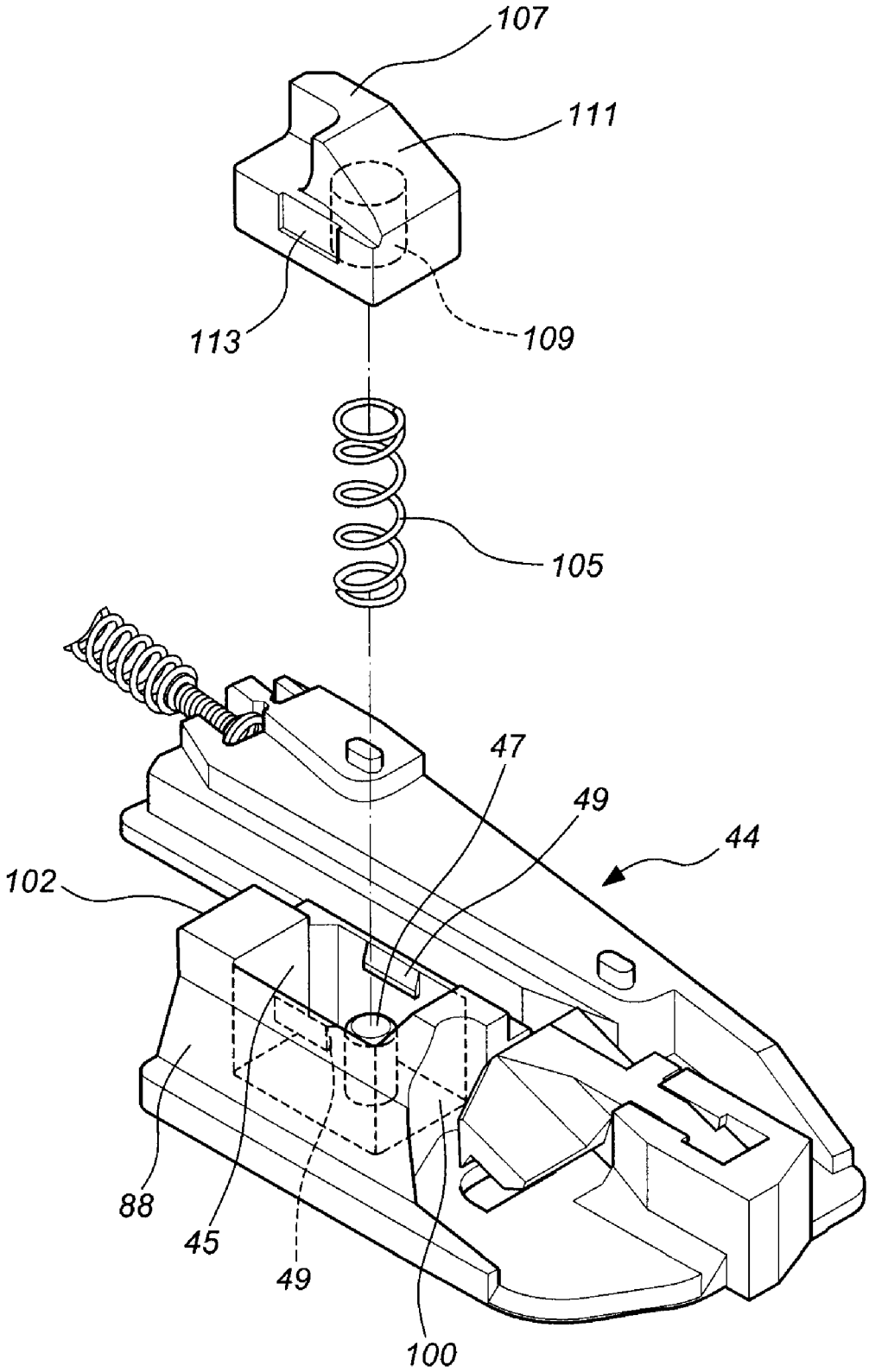
FIG. 3 is an exploded view showing a retaining mechanism and an adjusting mechanism according to a second preferred embodiment of the present invention.

As shown in FIG. 3, another preferred embodiment of the coupling portion 104 of the slide base 44 further comprises a third elastic member 105 mounted on the slide base 44, a coupling member 107 movably disposed between the first wall 100 and the second wall 102 of the third portion 88 of the slide base 44. The coupling member 107 urged by the third elastic member 105 is movable, functioning as the coupling portion 104. In a preferred embodiment, the side base 44 has an accommodation room 45 and a pair of protruding portions 49 at inner sides of the accommodation room 45. The coupling member 107 comprises a pair of concave portions 113 corresponding to and engaging with the protruding portions 49 respectively, preventing the coupling member 107 in the accommodation room 45 from disengagement. The third elastic member 105 is located between the accommodation room 45 of the slide base 44 and the coupling member 107. Preferably, the coupling member 107 is formed with a spring room 109, and a supporting post 47 is provided in the accommodation room 45 for the third elastic member 105 to be secured on the supporting post 47 and secured in the spring room 109 of the coupling member 107. The coupling member 107 has an inclined plane 111 on an upper end thereof.

The locking member 50 is located between the guiding member 42 and the slide base 44. In this embodiment, the locking member 50 has a first end 110 and a second end 112 opposing to the first end 110. The first end 110 of the locking member 50 is connected to the second portion 86 of the slide base 44, while the second end 112 of the locking member 50 is urged by the elastic piece 52 to act on the locking member 50. The second end 112 of the locking member 50 is forced to raise upwardly with respect to the slide base 44. The locking member 50 further has a first transverse portion 114 disposed between the first end 110 and the second end 112 and a second transverse portion 116. A locking space 118 is defined between the second transverse portion 116 and the first wall 100 of the slide base 44, referring to FIG. 1.

Figure 4:
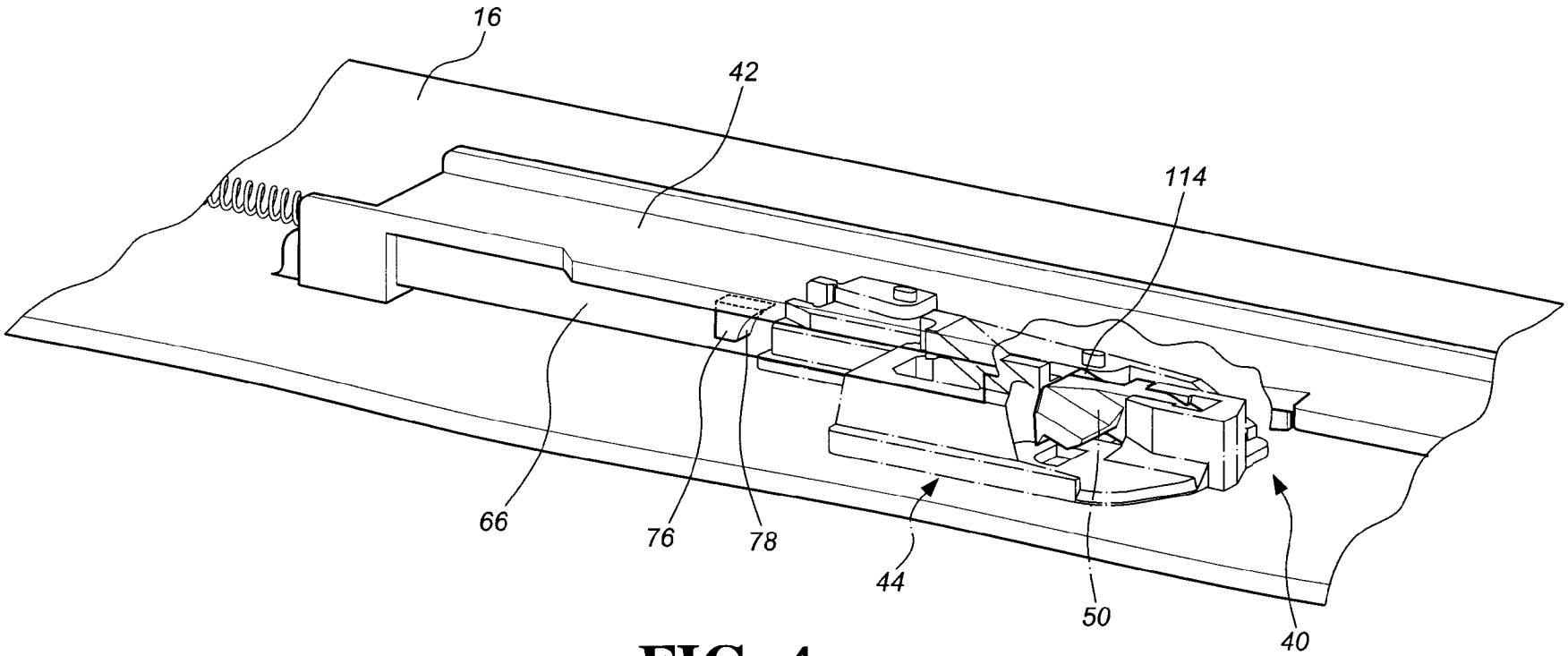
FIG. 4 is an assembled perspective view of the closing mechanism according to the first preferred embodiment of the present invention.

FIG. 4 shows the installation of the guiding member 42, the slide base 44 and the locking member 50. The guiding member 42 further comprises a stop portion 76 disposed at one side of the fourth longitudinal portion 66. The stop portion 76 has a guiding surface 78 corresponding to the first transverse portion 114 of the locking member 50, and is adapted to guide the first transverse portion 114 of the locking member 50 to slide along the guiding surface 78 and movable at an angle to the guiding surface 78. The sliding movement of the first transverse portion 114 presses the elastic piece 52 located between the locking member 50 and the slide base 44, referring to FIG. 2. That is to say, the locking member 50 is movable against the stop portion 76.

Figure 5:
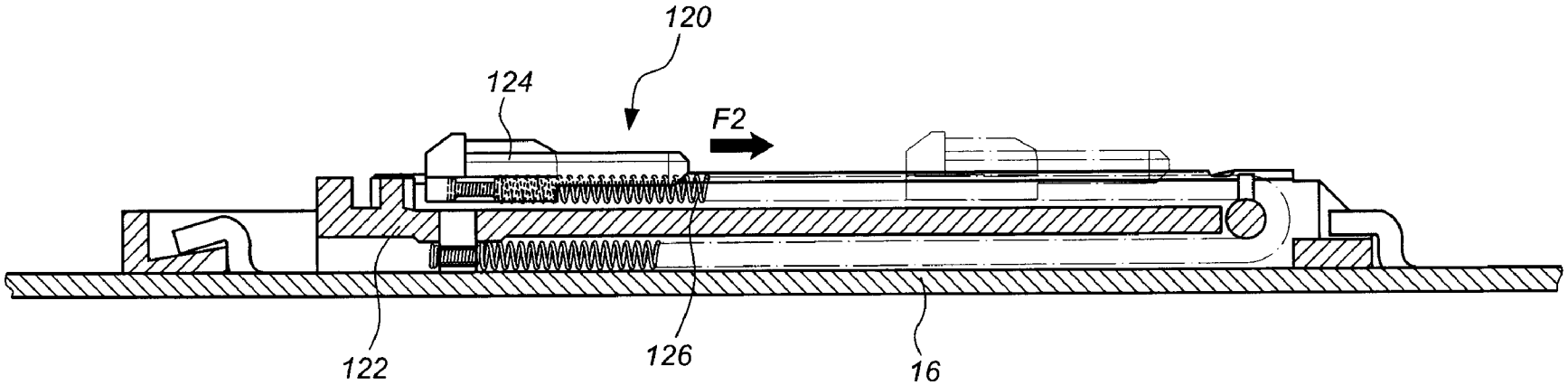
FIG. 5 is a cross-sectional view showing an opening mechanism according to the first preferred embodiment of the present invention.
Figure 6:
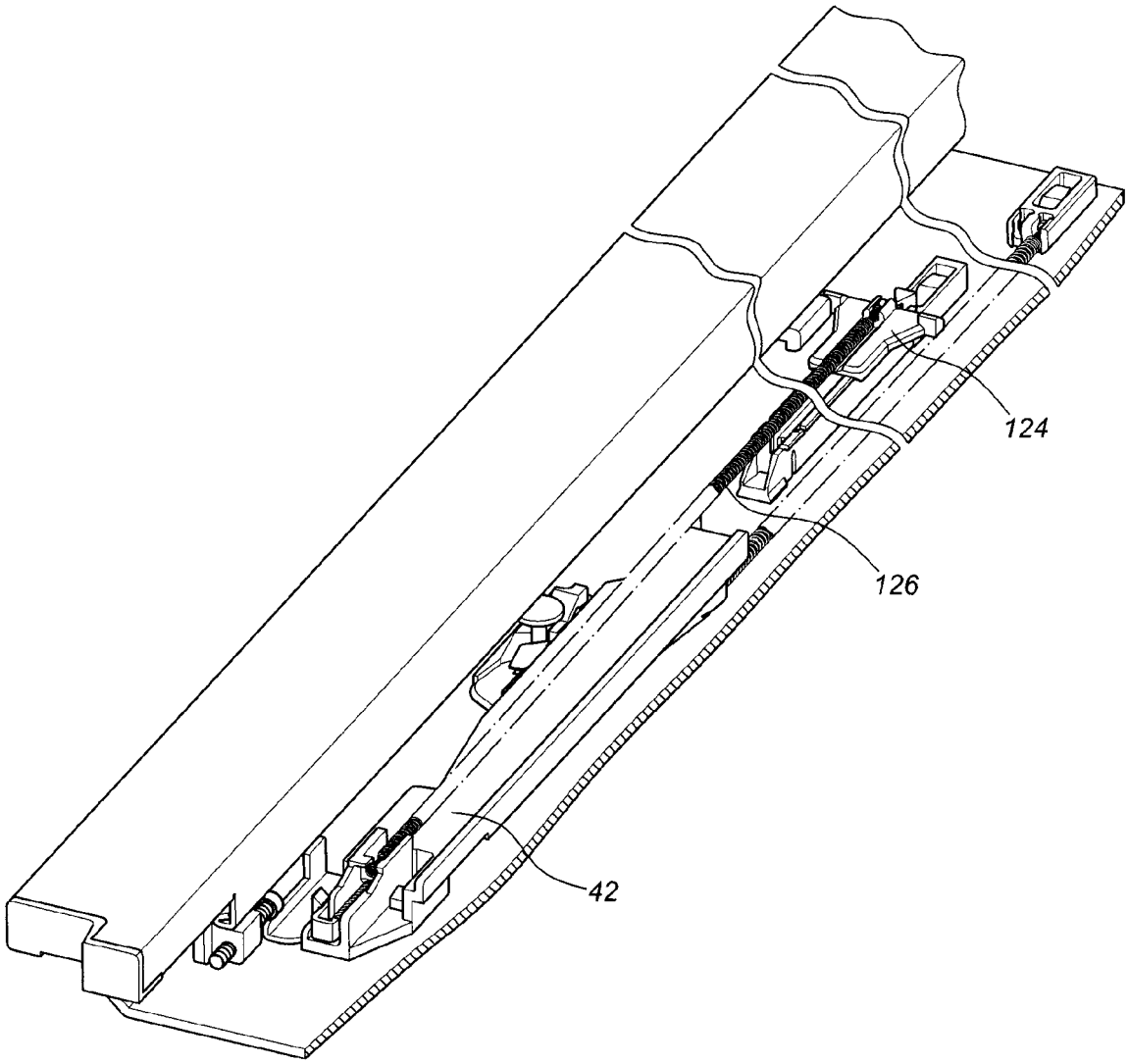
FIG. 6 is a perspective view showing engagement of a slide base according to the second preferred embodiment of the present invention.

FIG. 5 shows the configuration of the opening mechanism 120. The fixed portion 122 is fixed on the stationary part 16. The push member 124 is longitudinally movable in the fixed portion 122. The second elastic member 126 is mounted between the fixed portion 122 and the push member 124 in such a manner that the push member 124 is urged by the second elastic member 126 to move towards the second direction F2 constantly. FIG. 6 shows another preferred embodiment of the present invention. The second elastic member 126 is secured between the push member 124 and the guiding member 42, so that the push member 124 is urged by the second elastic member 126 to move towards the second direction F2.

Figure 7:
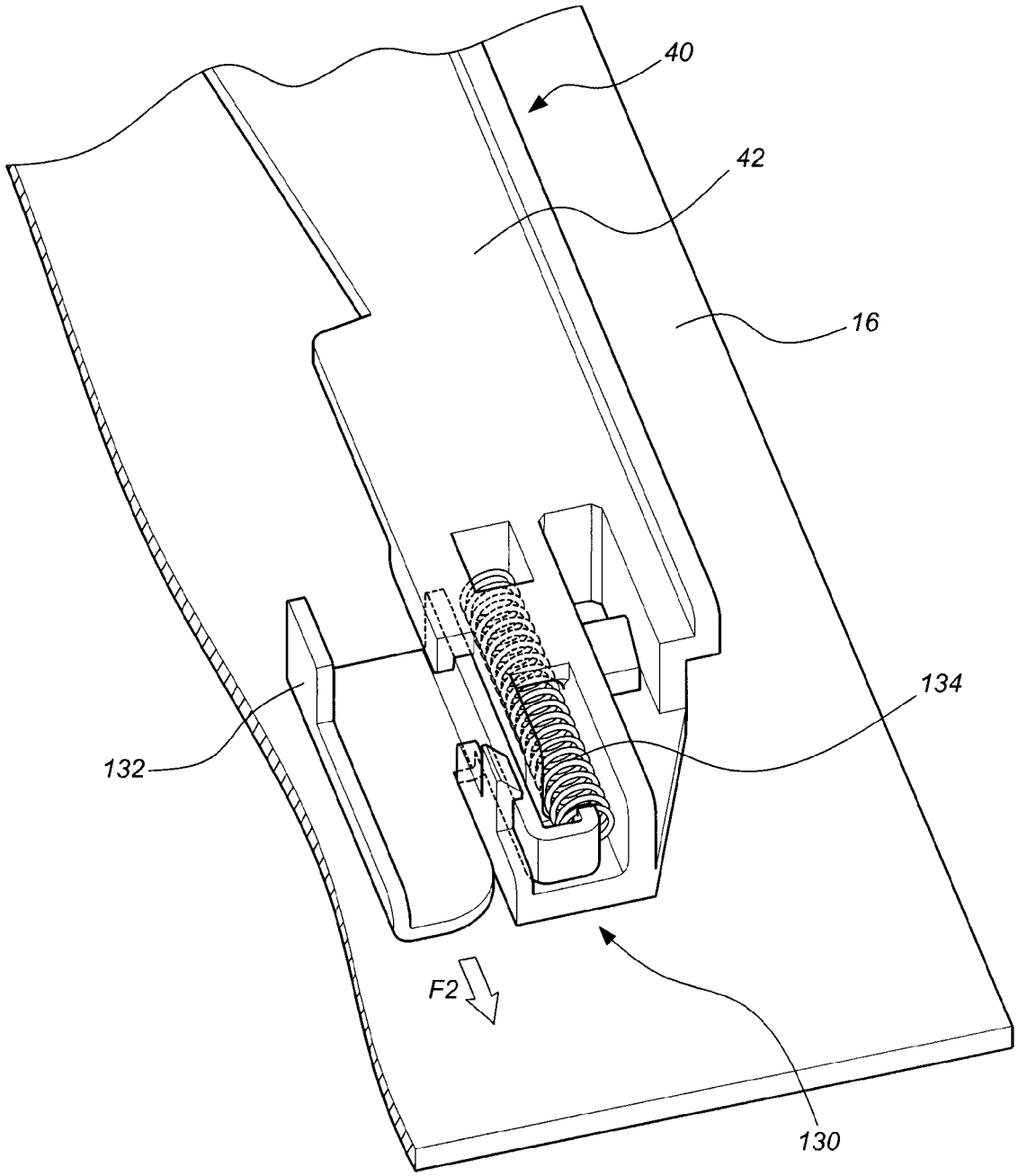
FIG. 7 is a perspective view showing the retaining mechanism according to the first preferred embodiment of the present invention.

As shown in FIG. 7, the retaining member 132 of the retaining mechanism 130 is longitudinally movable in the guiding member 42 of the closing mechanism 40. The retaining spring 134 is disposed on the stationary part 16 and connected between the retaining member 132 and the guiding member 42. The elastic force of the retaining spring 134 acts on the retaining member 132 so that the retaining member 132 is urged to move towards the second direction F2 constantly. When the retaining member 132 is urged by an external force towards a direction opposite to the second direction F2, the retaining spring 134 will be compressed and the retaining member 132 will be longitudinally moved with respect to the guiding member 42.

Figure 8:
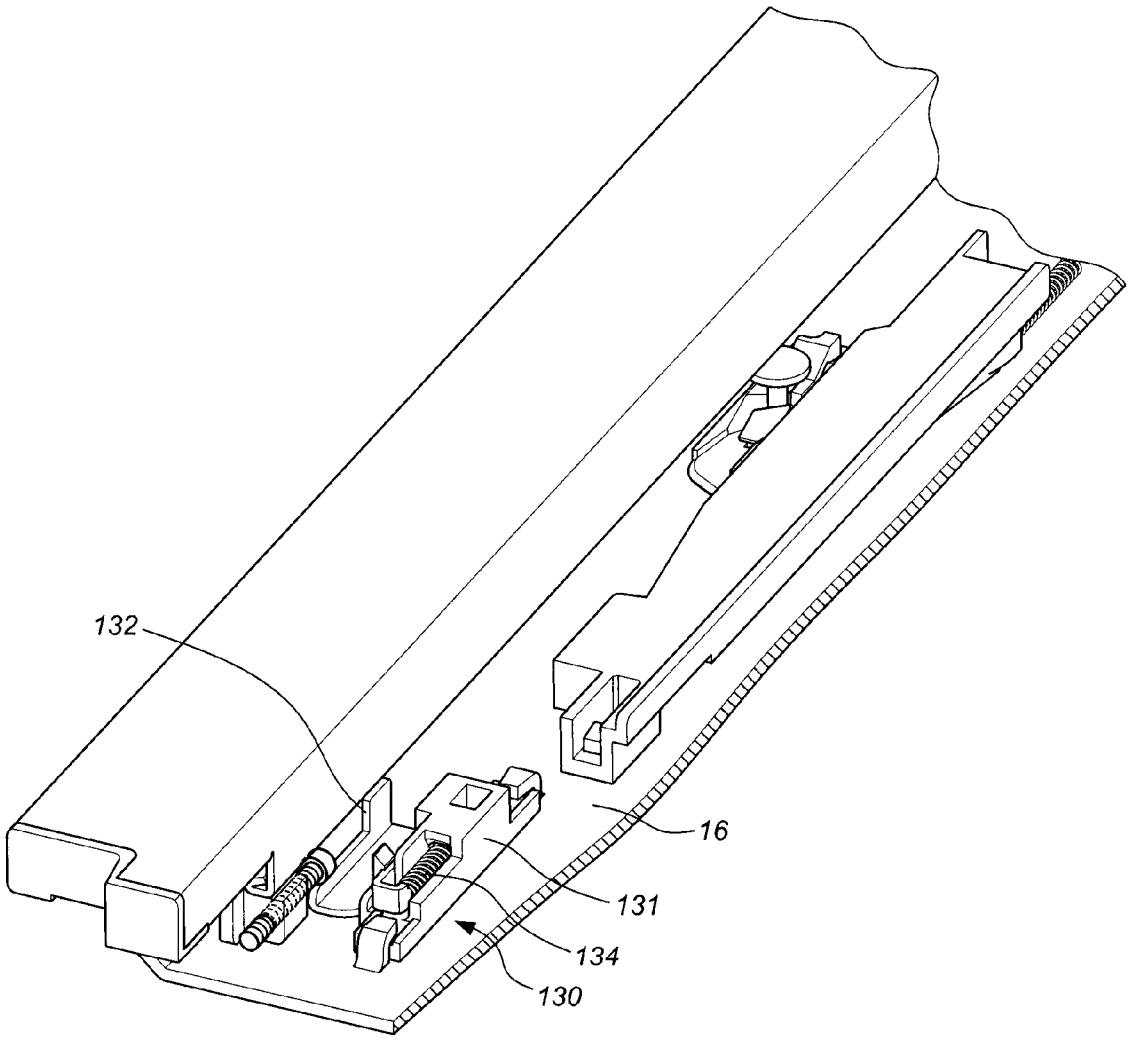
FIG. 8 is a perspective view showing the retaining mechanism according to the second preferred embodiment of the present invention.

FIG. 8 shows another preferred embodiment of the retaining mechanism 130, which comprises a retaining seat 131 fixed on the stationary part 16, the retaining member 132 is longitudinally movable in the retaining seat 131, and the retaining spring 134 disposed between the retaining member 132 and the retaining seat 131. The retaining member 132 is urged by the retaining spring 134 to keep the retaining member 132 to move towards the second direction F2 constantly.

Figure 9:
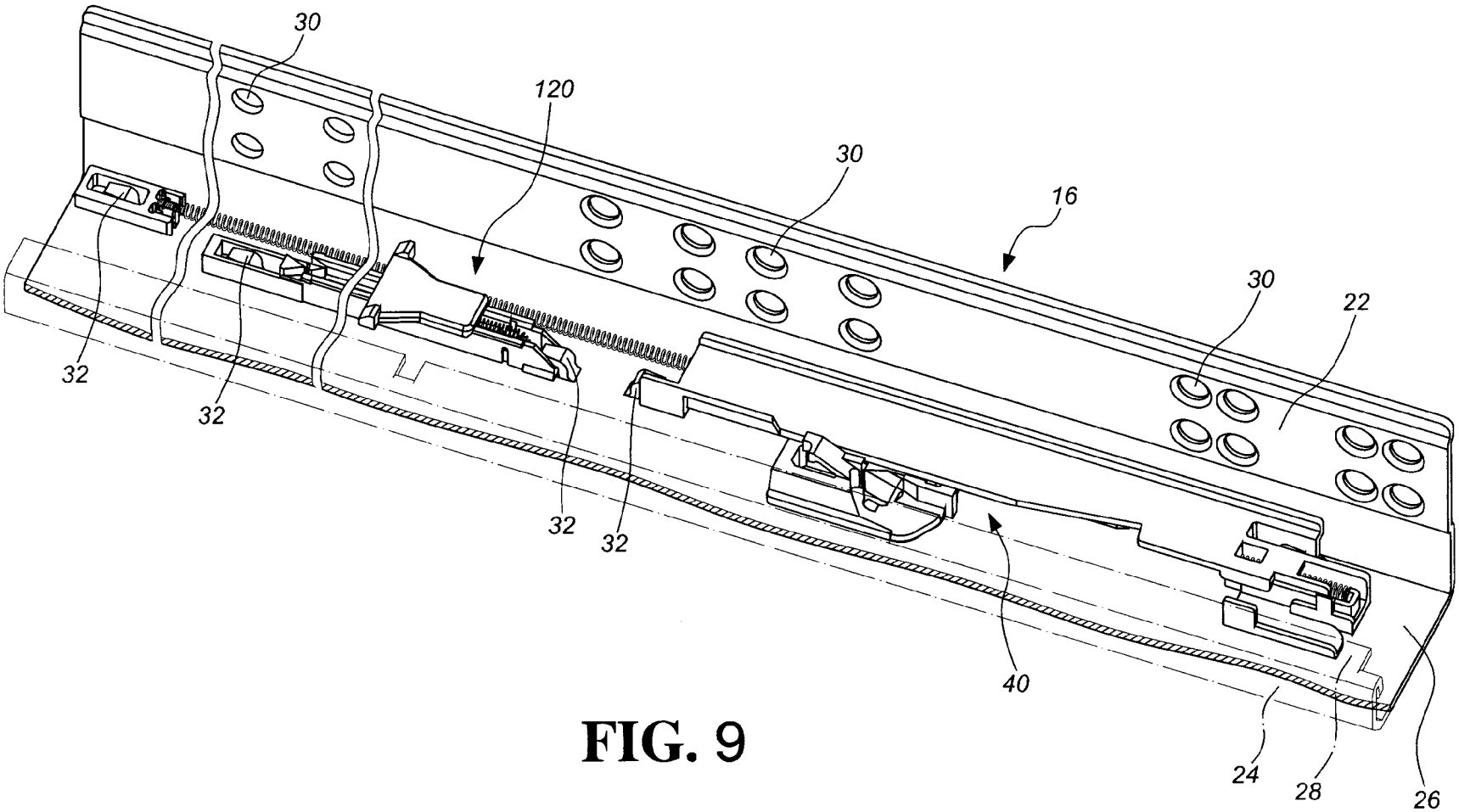
FIG. 9 is a perspective view showing the self-moving device mounted on a stationary rail according to the first preferred embodiment of the present invention.

As shown in FIG. 9, the stationary part 16 is in the form of a stationary rail. The stationary part 16 has a first side wall 22, a second side wall 24, a bottom 26 extending between the first side wall 22 and the second side wall 24, and an upper wall 28 transversely extending from the second side wall 24. Preferably, the first side wall 22 of the stationary part 16 is formed with a plurality of holes 30 such that the stationary part 16 is secured to a cabinet, a stationary frame or the like with fastening members, such as screws or bolts. The bottom 26 of the stationary part 16 is provided with a plurality of mounting portions 32 which may be in the form of protruding portions or concave holes for facilitating installation of the closing mechanism 40 and the opening mechanism 120.

Figure 10:
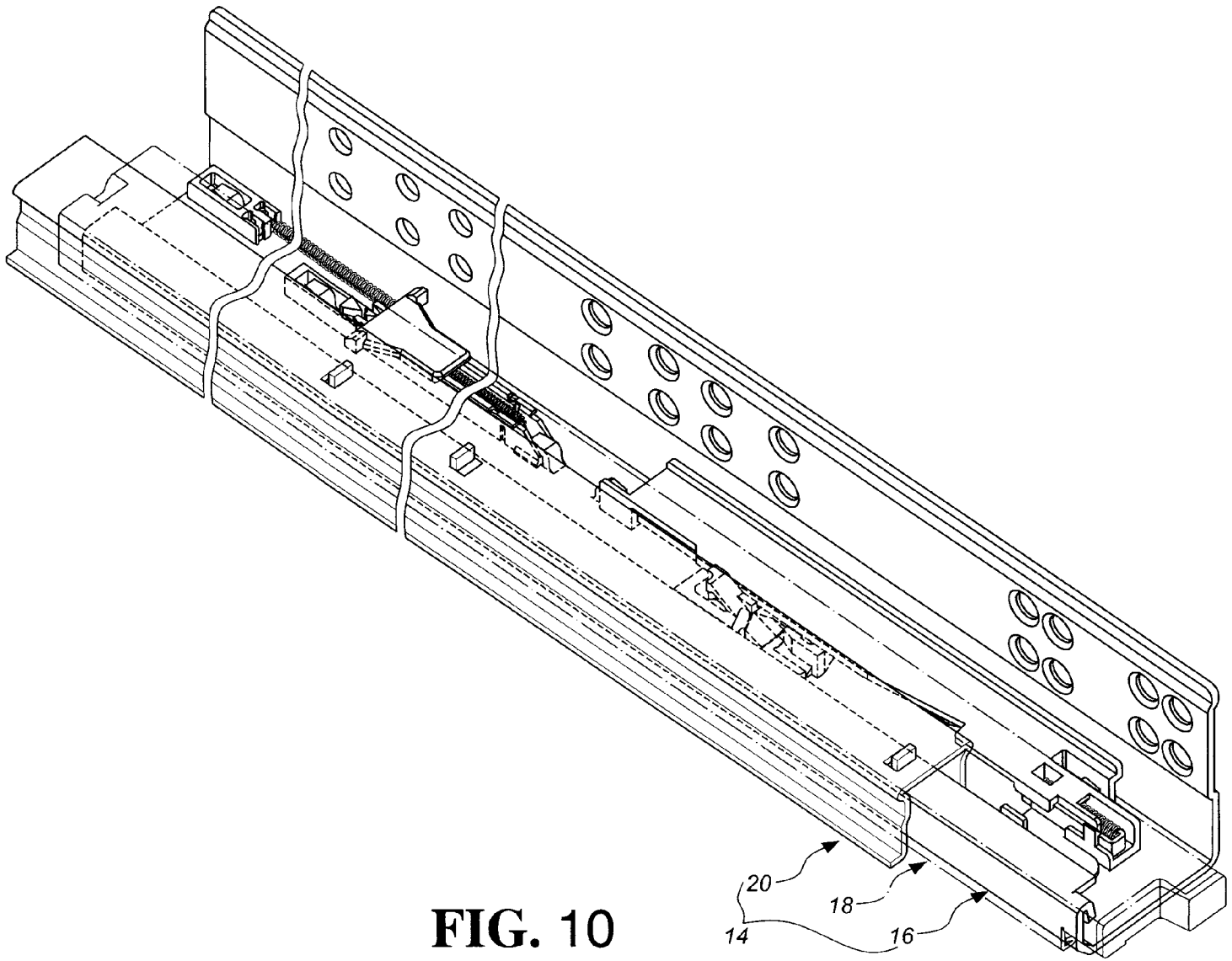
FIG. 10 is perspective view showing the self-moving device mounted on a slide assembly according to the first preferred embodiment of the present invention.

FIG. 10 shows the configuration of a slide assembly 14. The slide assembly 14 comprises a first movable part 18 to slide longitudinally with respect to the stationary part 16, and a second movable part 20 disposed between the stationary part 16 and the first movable part 18. The first movable part 18 and the second movable part 20 are extendable with respect to the stationary part 16. In this embodiment, the stationary part 16 is a stationary rail, the first movable part 18 is a movable rail, and the second movable part 20 is an extension rail. The stationary part 16 may be mounted on a cabinet, a stationary frame or the like. The first movable part 18 may be mounted to a drawer, a movable frame or the like such that the drawer, the movable frame or the like may be pulled out from the cabinet, the stationary frame or the like by means of the movable part 18. The second movable part 20 is adapted to assist the first movable part 18 in extending for a long distance.

As shown in FIGS. 11, 11*a* and 11*b*, the movable part 18 comprises a first connecting portion 34 and a second connecting portion 36. The slide base 44 corresponds to the first connecting portion 34 and the second connecting portion 36. When the movable part 18 is retracted with respect to the stationary part 16, the first connecting portion 34 and the second connecting portion 36 correspond to the closing mechanism 40 and the opening mechanism 120, respectively. The second transverse portion 116 of the locking member 50 and the first wall 100 of the third portion 88 of the closing mechanism 40 define the locking space 118 which is provided for the first connecting portion 34 of the movable part 18 to be positioned thereat. The push member 124 is engaged with the second connecting portion 36 of the movable part 18 and urged by the second elastic member 126 located between the fixed portion 122 and the push member 124 to push the second connecting portion 36 of the movable part 18 to move towards the second direction F2.

Figure 12:
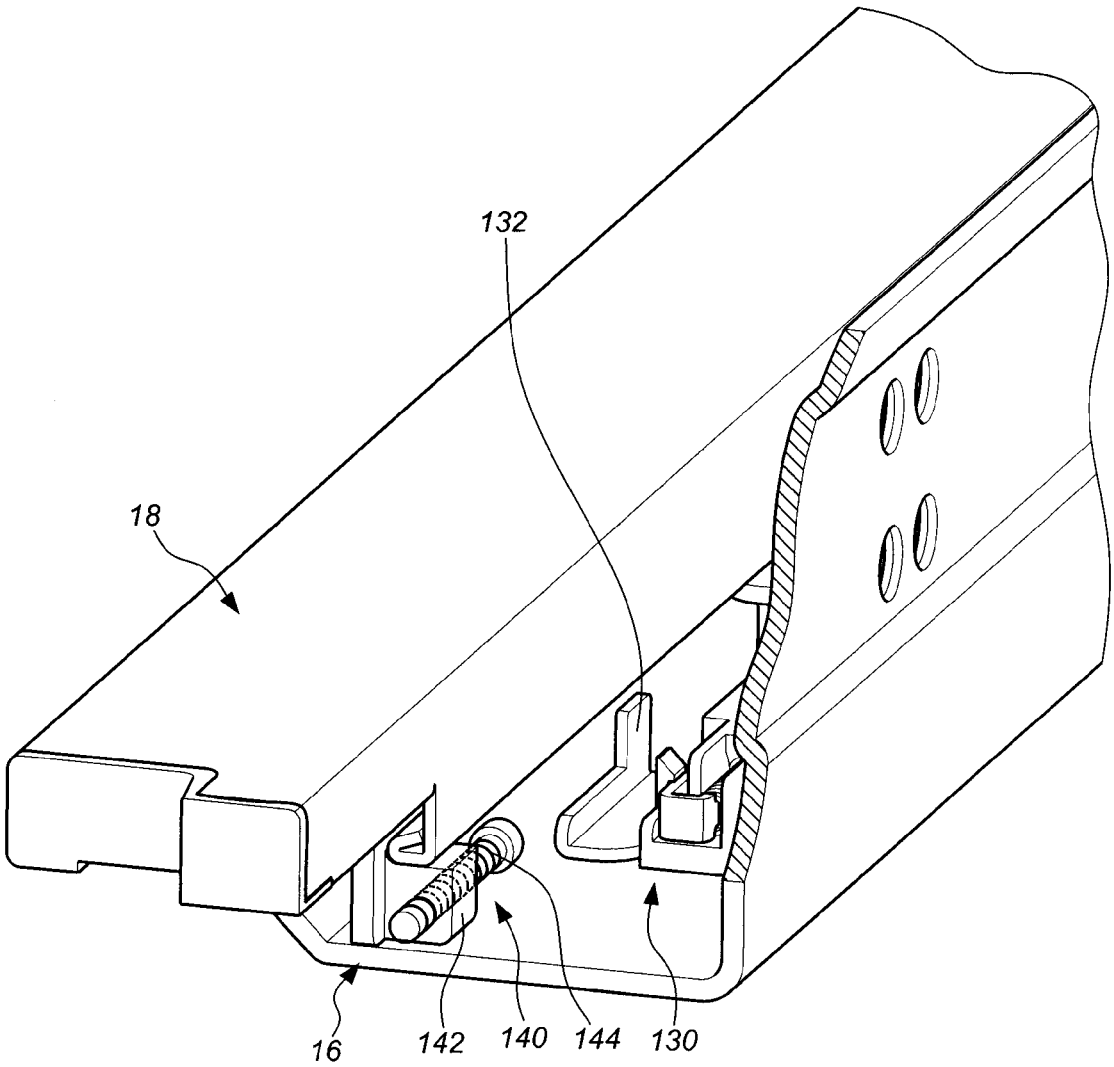
FIG. 12 is a partially sectioned perspective view showing the adjusting mechanism according to the first preferred embodiment of the present invention.

As shown in FIG. 12, the present invention further comprises an adjusting mechanism 140. The adjusting mechanism 140 comprises a base 142 fixedly connected to the movable part 18 and a movable adjusting member 144 which may be a threaded member to secure the base 142. The adjusting member 144 may be adjusted its distance with respect to the retaining member 132 of the retaining mechanism 130 for adjustment of the position between the movable part 18 and the stationary part 16.

Figure 13A:
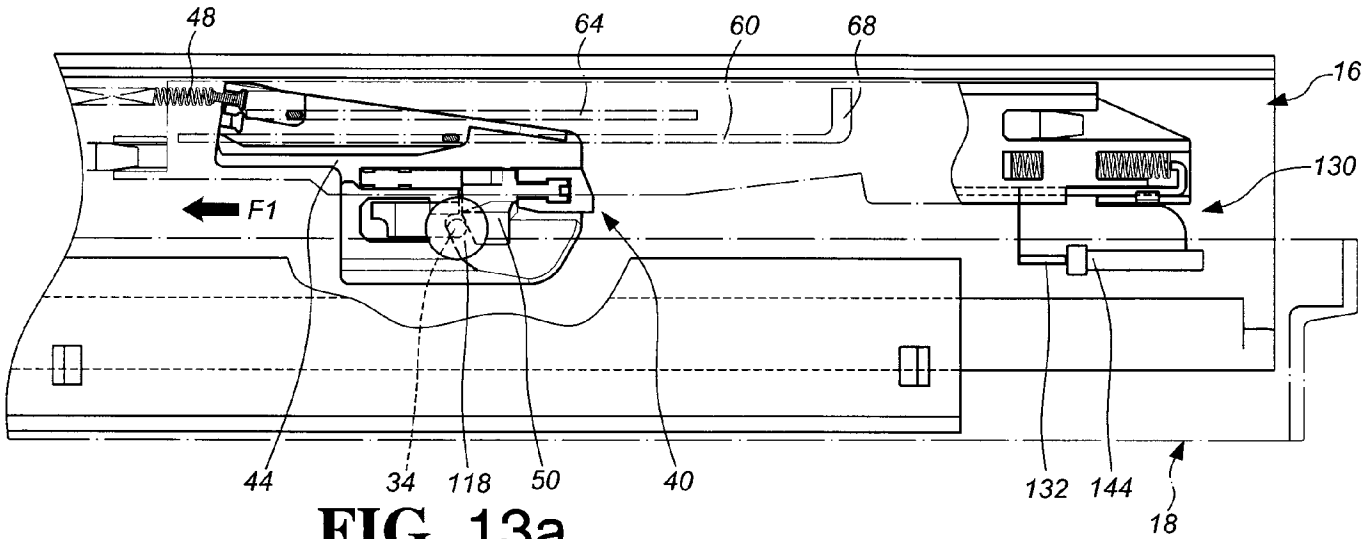
FIG. 13*a* is a schematic view showing a movable part in a retracted status according to the first preferred embodiment of the present invention.
Figure 13B:
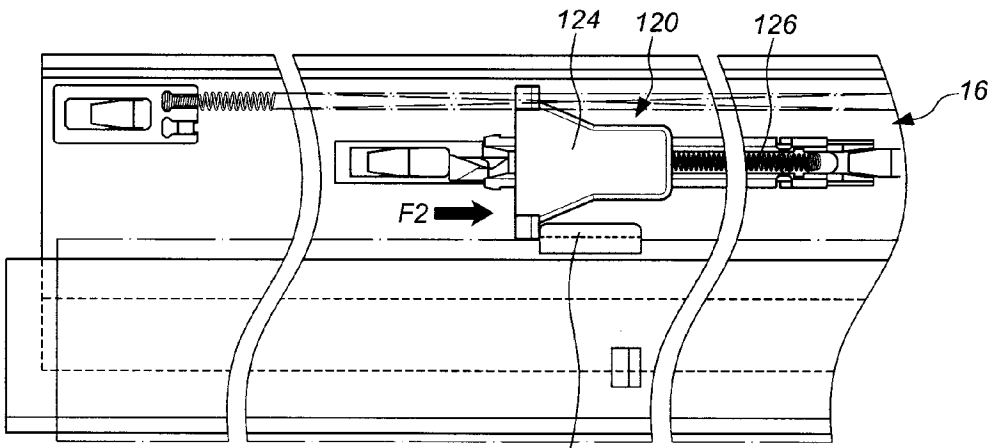
FIG. 13*b* is another schematic view showing the movable part in a retracted status according to the first preferred embodiment of the present invention.

As shown in FIGS. 13*a* and 13*b*, the closing mechanism 40 acts on the movable part 18 and the movable part 18 is retracted with respect to the stationary part 16. The first connecting portion 34 is located in the locking space 118 defined between the slide base 44 and the locking member 50. When the locking member 50 is pulled backwards by the slide base 44 with the first elastic member 48, the locking member 50 will hold the first connecting portion 34, which links the movable part 18 to be pulled by the first elastic member 48 to move towards the first direction F1 to a closed position with respect to the stationary part 16. The second connecting portion 36 is pulled backwards and engaging with the push member 124 of the opening mechanism 120 which is also pulled backwards. Since the elastic force of the second elastic member 126 is less than that of the first elastic member 48, the push member 124 is pulled by the second connecting portion 36 to move backwards. The second elastic member 126 has an initiative force towards the second direction F2 which acts on the push member 124. The adjusting member 144 engages with the retaining member 132 at this moment to position the movable part 18 in place, thus the movable part 18 is moved towards the first direction F1 as the stationary part 16 does.

Figure 14A:
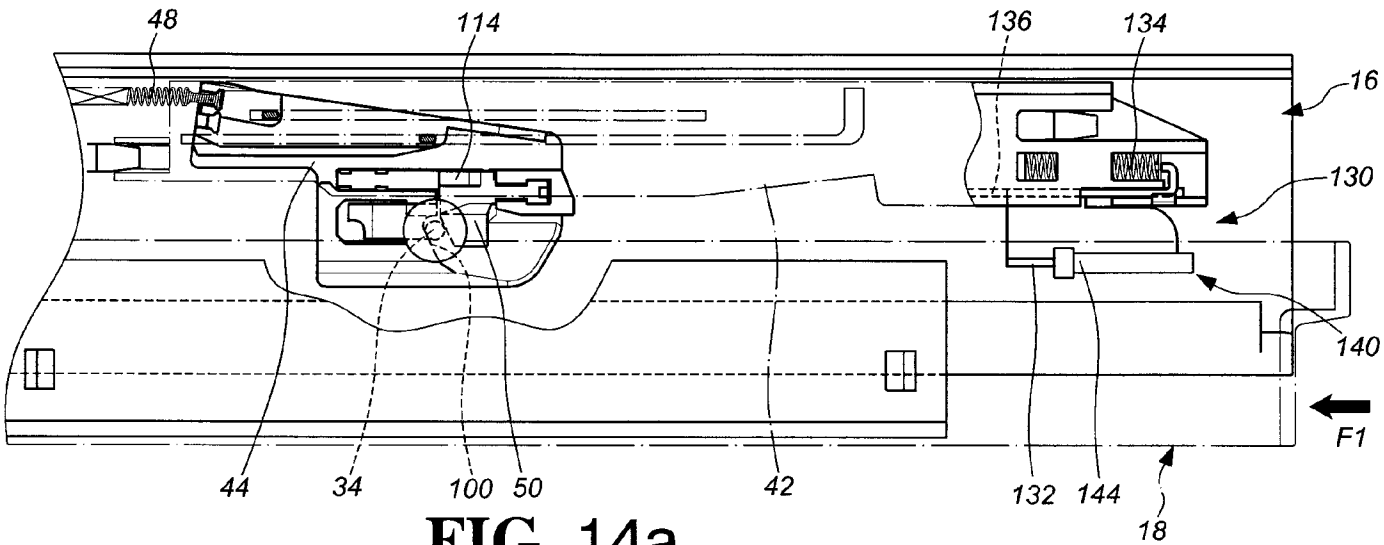
FIG. 14*a* is a schematic view showing the movable part pushed by an external force according to the first preferred embodiment of the present invention.
Figure 14B:
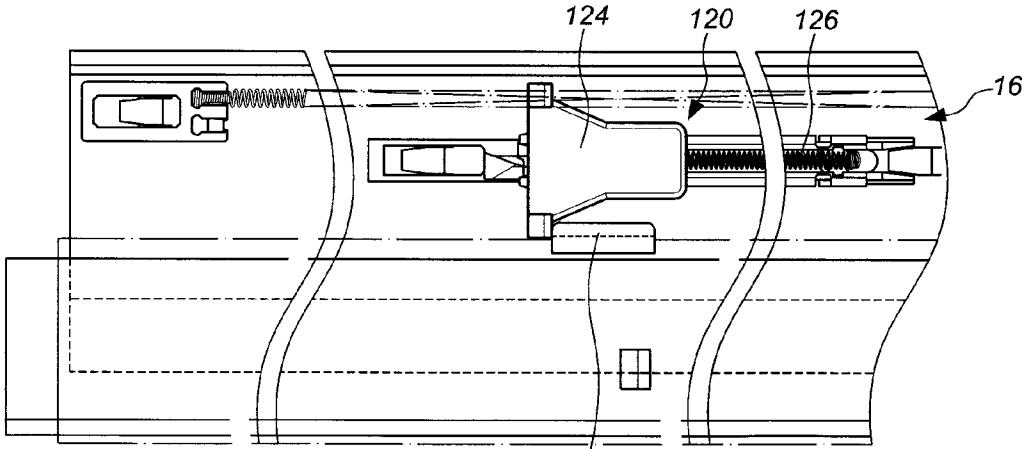
FIG. 14*b* is another schematic view showing the movable part pushed by the external force according to the first preferred embodiment of the present invention.
Figure 15:
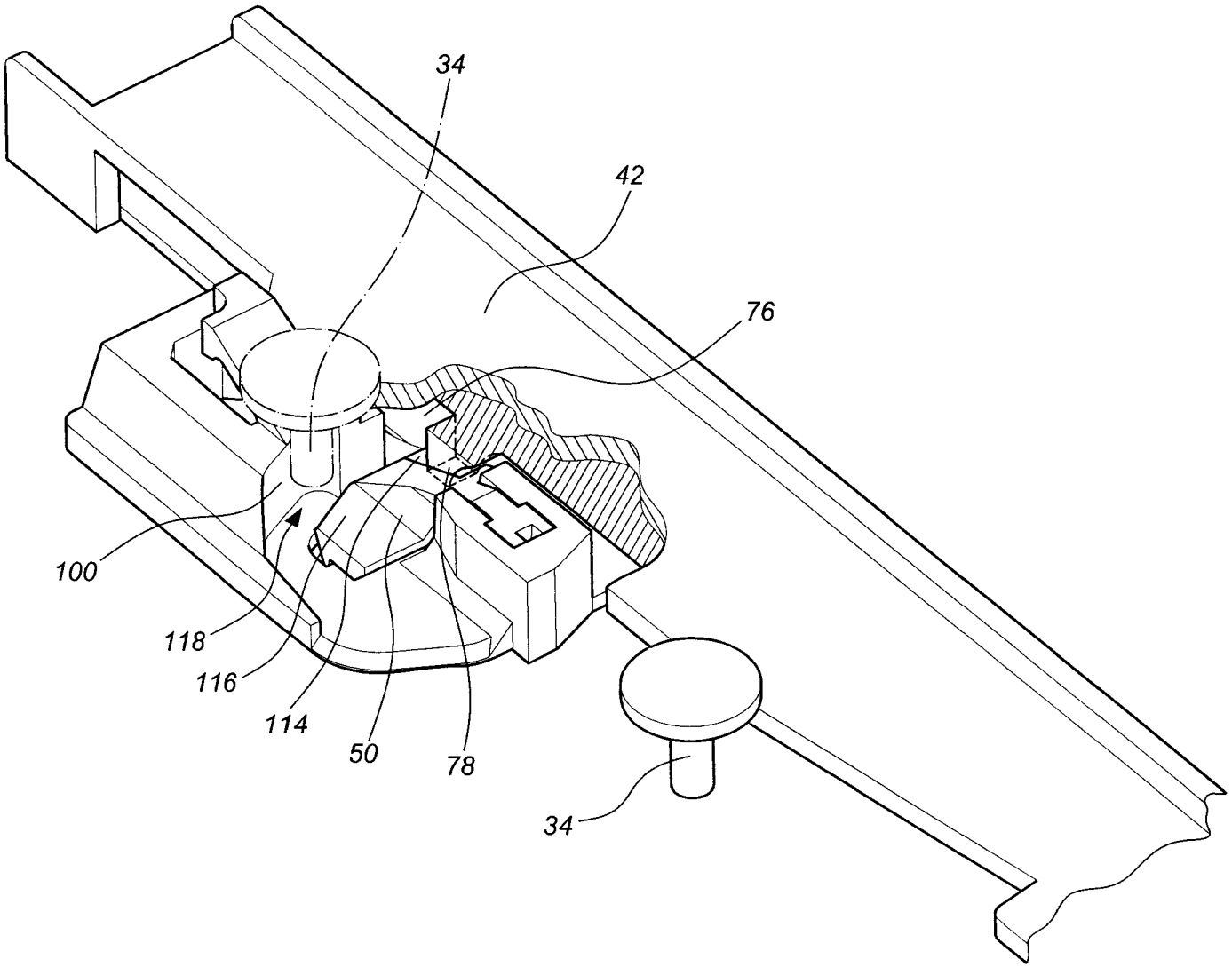
FIG. 15 is a perspective view showing a locking member guided by a guiding member to deflect when the movable part is pushed by the external force according to the first preferred embodiment of the present invention.

As shown in FIGS. 14*a*, 14*b*, and 15, when the movable part 18 is pushed to move towards the first direction F1 and the adjusting member 144 of the adjusting mechanism 140 pushes the retaining member 132 of the retaining mechanism 130, the retaining member 132 will press the retaining spring 134 to move longitudinally with respect to the guiding member 42. Meantime, the first connecting portion 34 of the movable part 18 pushes the first wall 100 of the slide base 44 to move backwards, which links the locking member 50 to move backwards along with the slide base 44. The first transverse portion 114 of the locking member 50 is linked to move along the guiding surface 78 of the stop portion 76 of the guiding member 42, hence the locking member 50 is brought to a level drop to press the elastic piece 52 between the locking member 50 and the slide base 44, referring to FIG. 2, which releases the engagement of the first connecting portion 34 of the movable portion 18 to form an open space in the locking space 118. The slide base 44 is pulled by the first elastic member 48 to move backwards and the moving force will be stopped when it encounters with the guiding member 42. Meanwhile, the push member 124 of the opening mechanism 120 is pushed by the second connecting portion 36 of the movable part 18. The push member 124 will pull the second elastic member 126 during the movement. The pushing force from the second elastic member 126 to the push member 124 is larger than the initiative force. Therefore, when an external force in the first direction F1 is applied to the movable part 18, the first connecting portion 34 of the movable part 18 will be disengaged from the locking space 118. When the external force in the first direction F1 is released, the opening mechanism 120 will have the second elastic member 126 against the push member 124 towards the second direction F2, and the second connecting portion 36 of the movable part 18 will be pushed out by the push member 124. Thus the movable part 18 is self-opening with respect to the stationary part 16, that is to say, the movable part 18 will be pushed outwards with respect to the stationary part 16. It means that the movable part 18 responds to the elastic force from the second elastic member 126 to generate a self-opening force with respect to the stationary part 16.

Figure 16A:
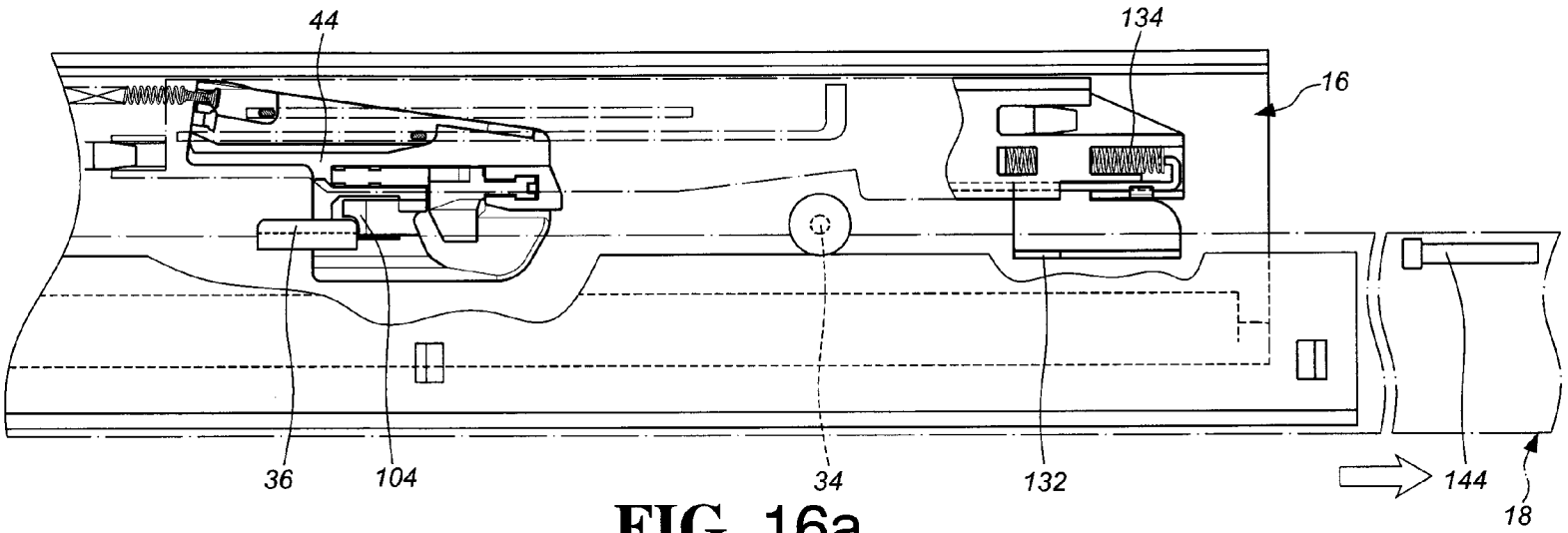
FIG. 16*a* is a schematic view showing the movable part forced in a self-opening status according to the first preferred embodiment of the present invention.
Figure 16B:
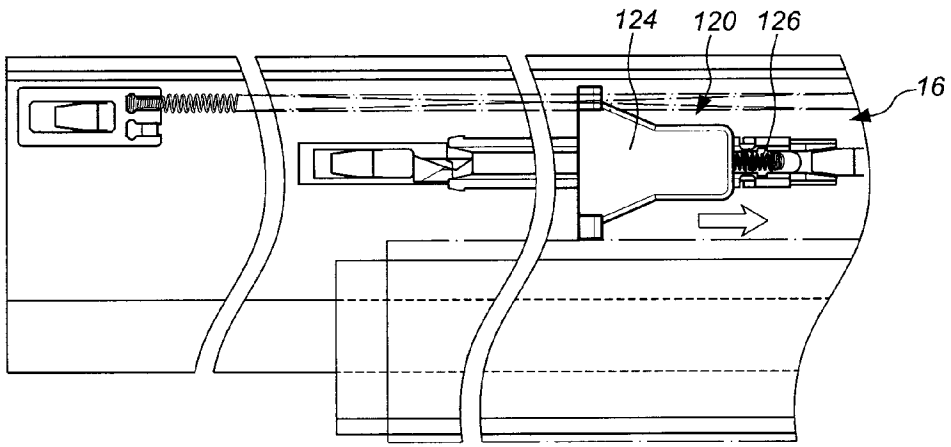
FIG. 16*b* is another schematic view showing the movable part forced in an open status according to the first preferred embodiment of the present invention.

FIGS. 16*a* and 16*b* show the open status of the movable part 18 with respect to the stationary part 16. The second connecting portion 36 of the movable part 18 is pushed outwards by the push member 124 which is urged by the second elastic member 126 of the opening mechanism 120. The elastic force released from the second elastic member 126 will push the second connecting portion 36 to an open status with respect to the stationary part 16. Preferably, the second connecting portion 36 is leaned against the coupling portion 104 and is stopped thereat, thus the movable part 18 remains in an open status with respect to the stationary part 16.

Figure 17:
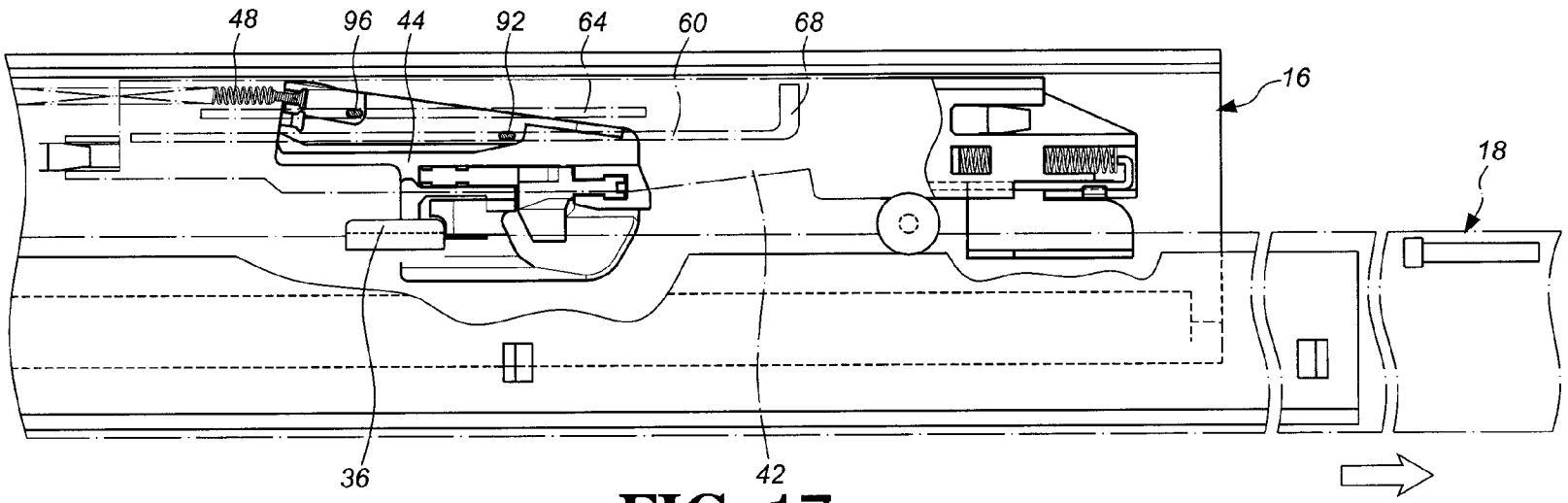
FIG. 17 is a schematic view showing the slide base linked by the movable part to move according to the first preferred embodiment of the present invention.

As shown in FIG. 17, the movable part 18 is already in an open status with respect to the stationary part 16. When the movable part 18 is pulled further away from the stationary part 16, the first sliding portion 92 and the third sliding portion 96 of the slide base 44 will be pulled by the second connecting portion 36 of the movable part 18 to slide along the first longitudinal portion 60 and the third longitudinal portion 64 of the guiding member 42.

Figure 18:
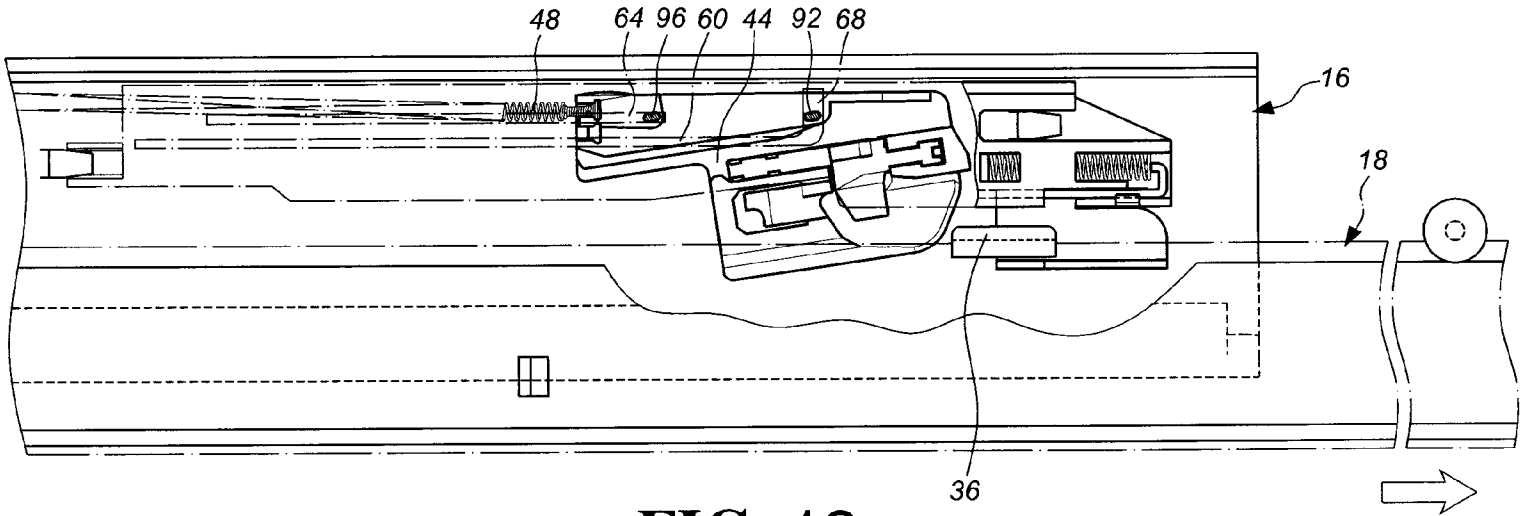
FIG. 18 is a schematic view showing the slide base linked by the movable part to deflect according to the first preferred embodiment of the present invention.

As shown in FIG. 18, the first sliding portion 92 and the third sliding portion 96 of the slide base 44 are pulled to move along the first longitudinal portion 60 and the third longitudinal portion 64 of the guiding member 42, upon the first sliding portion 92 reaches the end of the first longitudinal portion 60, it will slide into the transverse portion 68 which is interconnected with the first longitudinal portion 60, which causes the slide base 44 to deflect with respect to the guiding member 42 and to disengage from the second connecting portion 36 of the movable part 18 and the guiding member 42. The elastic force of the first elastic member 48 acts on the slide base 44 such that the slide base 44 is in an oblique and positioned status with respect to the guiding member 42 and the movable member 18 is free to be pulled outwards with respect to the stationary part 16.

Figure 19:
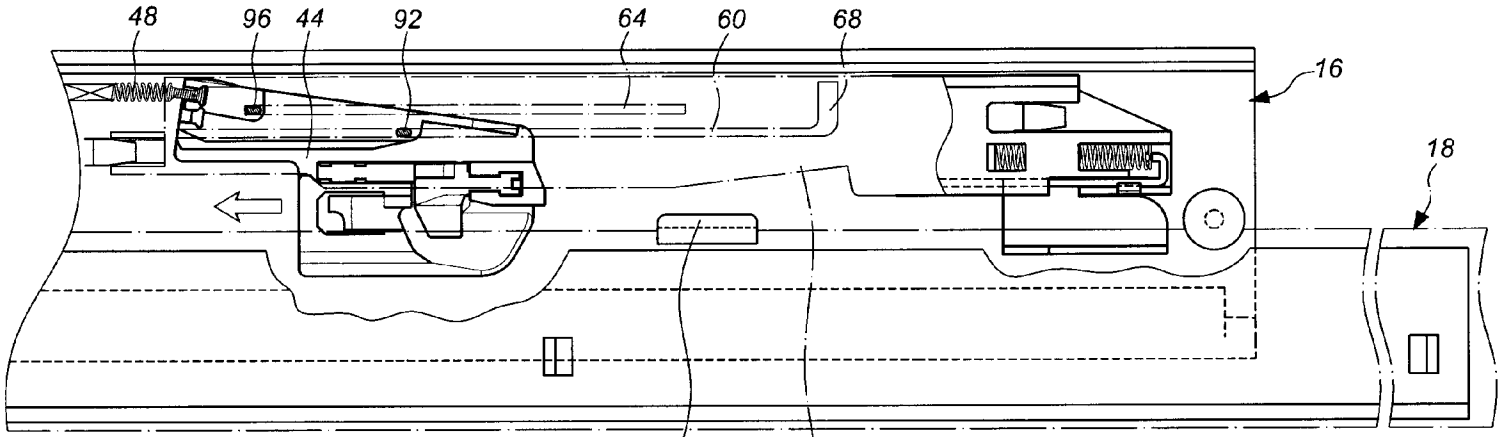
FIG. 19 is a schematic view showing the slide base malfunctioning and being pulled back according to the first preferred embodiment of the present invention.

After the movable part 18 is kept in an open status with respect to the stationary part 16, the first sliding portion 92 of the slide base 44 will stay in the transverse portion 68 of the guiding member 42. If the first sliding portion 92 of the slide base 44 is accidentally detached from the transverse portion 68 of the guiding member 42 and slides into the first longitudinal portion 60, as shown in FIG. 19, the slide base 44 is pulled by the first elastic member 48 backwards, which causes the third sliding portion 96 of the slide base 44 to slide to the distal end of the third longitudinal portion 64 and stopped thereat in a disengaged status.

Figure 20:
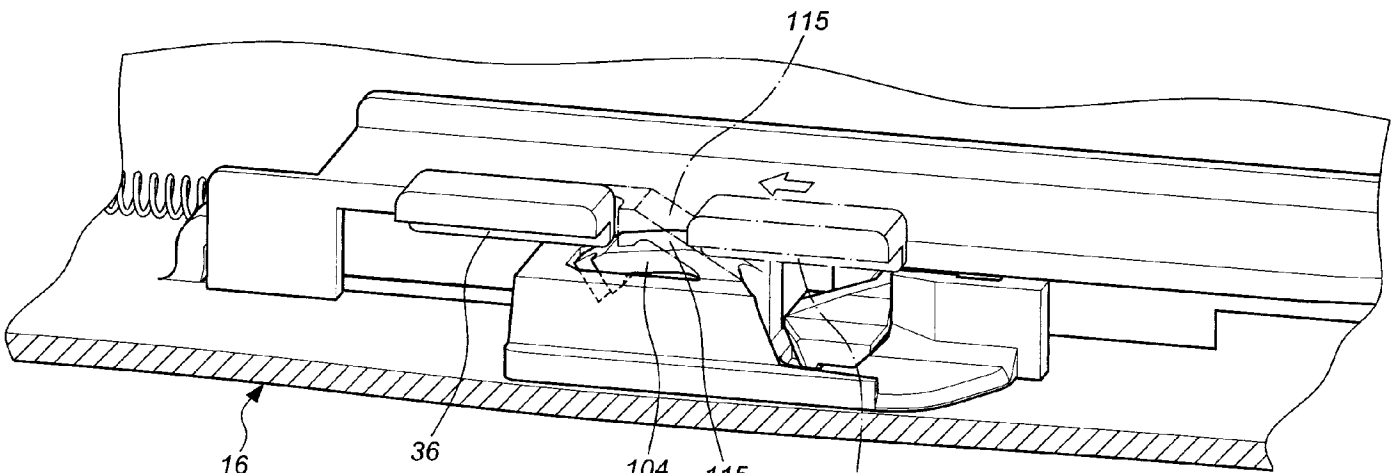
FIG. 20 is a schematic view showing the second connecting portion being engaged with the slide base again according to the first preferred embodiment of the present invention.
Figure 21:
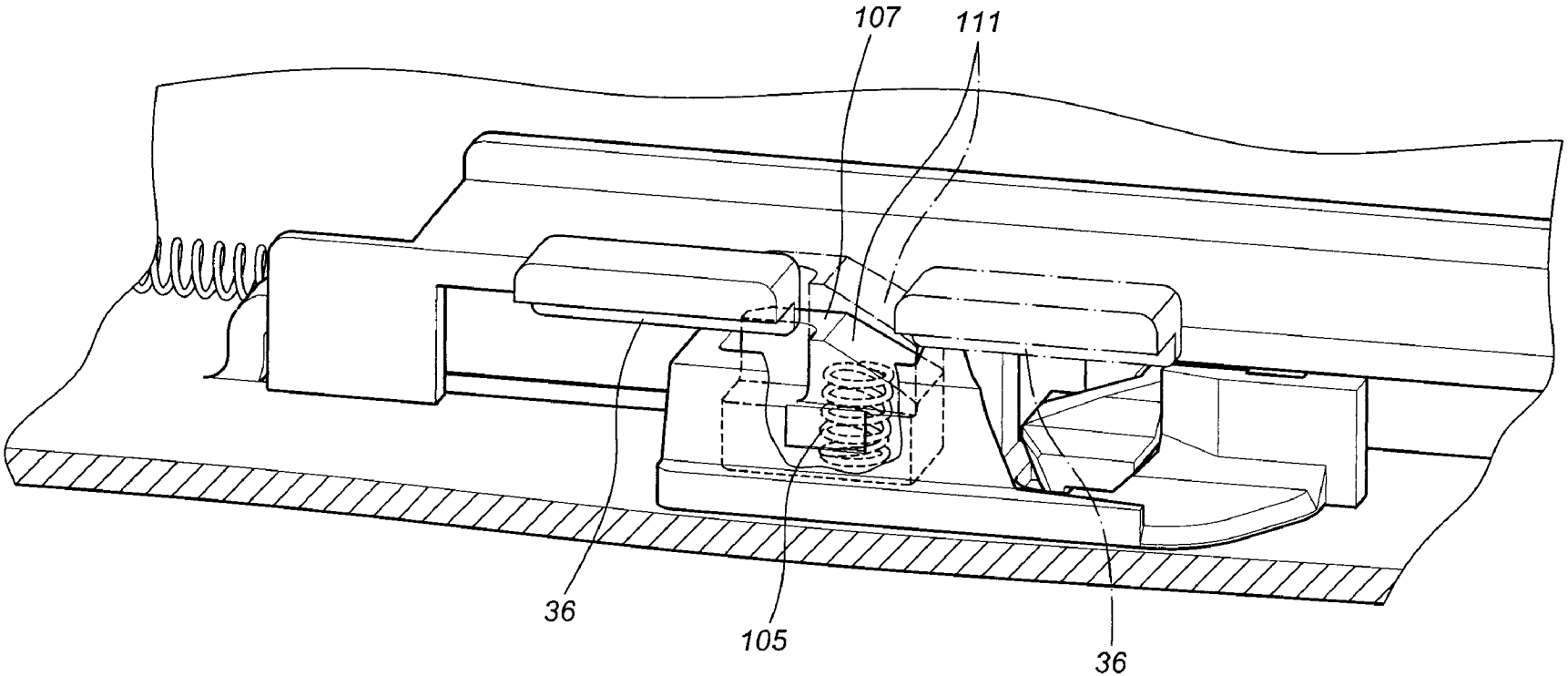
FIG. 21 is a schematic view showing the second connecting portion being engaged with a coupling member again according to the second preferred embodiment of the present invention.

As shown in FIG. 20, the disengaged status is released. The movable part 18 is retracted into the stationary part 16. The second connecting portion 36 of the movable part 18 engages with inclined surface 115 of the coupling portion 104. By pushing the movable part 18 inwards, the second connecting portion 36 will slide along the coupling portion 104 of the slide base 44 and a further pushing force will bring the second connecting portion 36 to slide over the coupling portion 104 of the slide base 44. By pulling the movable portion 18 outwards with respect to the stationary part 16, the slide base 44 is linked to slide along the first longitudinal portion 60 of the guiding member 42 until the first sliding portion 92 of the slide base 44 reaches the transverse portion 68 and the slide base 44 is inclined to a positioned position, referring to FIGS. 17 and 18. Alternatively, when the movable part 18 is pushed inwards with respect to the stationary part 16, as shown in FIG. 21, the second connecting portion 36 of the movable part 18 engages with inclined plane 111 of the coupling member 107. The movement of the second connecting portion 36 will continue when the pushing force from the movable part 18, the second connecting portion 36 will slide along the coupling member 107 to press the third elastic member 105 and then slide over the coupling member 107. The third elastic member 105 applies its elastic force to the coupling member 107 so that the coupling member 107 returns its original position. The movable part 18 is pulled to move outwards with respect to the stationary part 16 to link the slide base 44 to slide.

Figure 22:
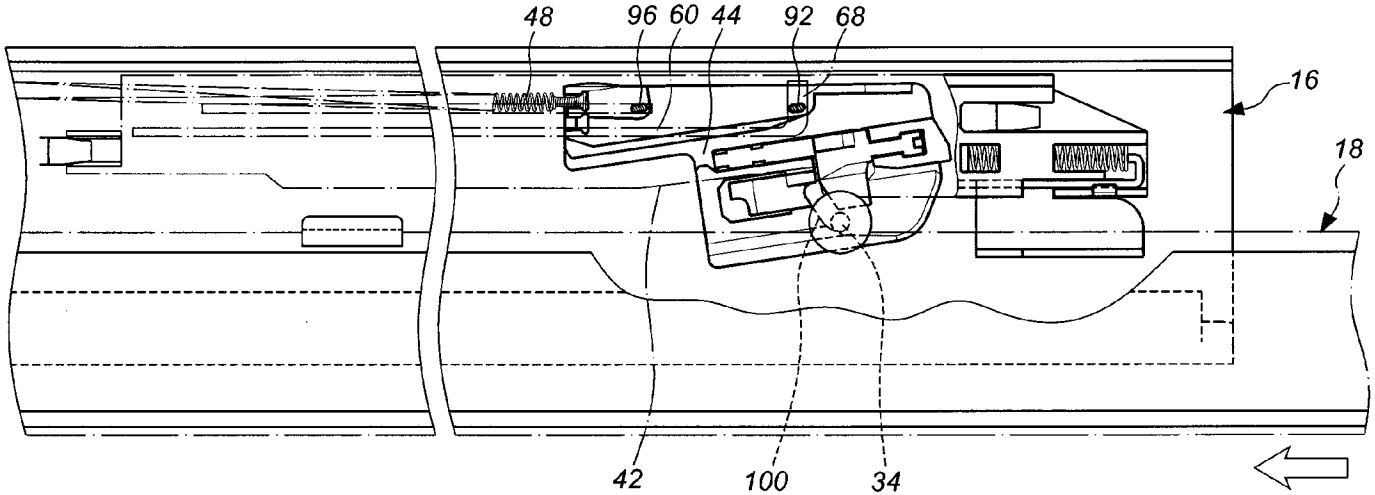
FIG. 22 is a schematic view showing the second connecting portion being engaged with the slide base according to the first preferred embodiment of the present invention.
Figure 23:
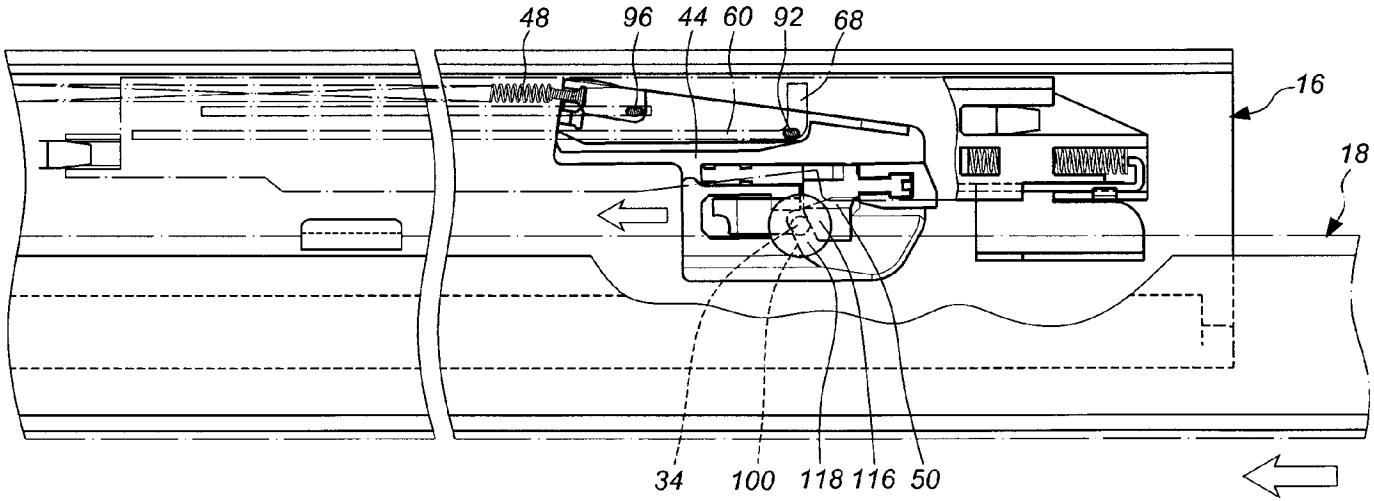
FIG. 23 is a schematic view showing the second connecting portion being pulled back according to the first preferred embodiment of the present invention.

As shown in FIGS. 22 and 23, the movable part 18 is pushed backwards with respect to the stationary part 16. When the first connecting portion 34 engages with the first wall 100 of the slide base 44 and the movable part 18 is retracted further, the slide base 44 will be linked to deflect until the first sliding portion 92 disengages from the transverse portion 68 of the guiding member 42 and returns to the first longitudinal portion 60 of the guiding member 42. The first connecting portion 34 is located in the locking space 118 defined between the second transverse portion 116 of the locking member 50 and the first wall 100 of the slide base 44. The slide base 44 is pulled backwards by the first elastic member 48 and the first connecting portion 34 of the movable part 18 is also pulled by the locking member 50 to move such that the movable part 18 is closed with respect to the stationary part 16.

Figure 24:
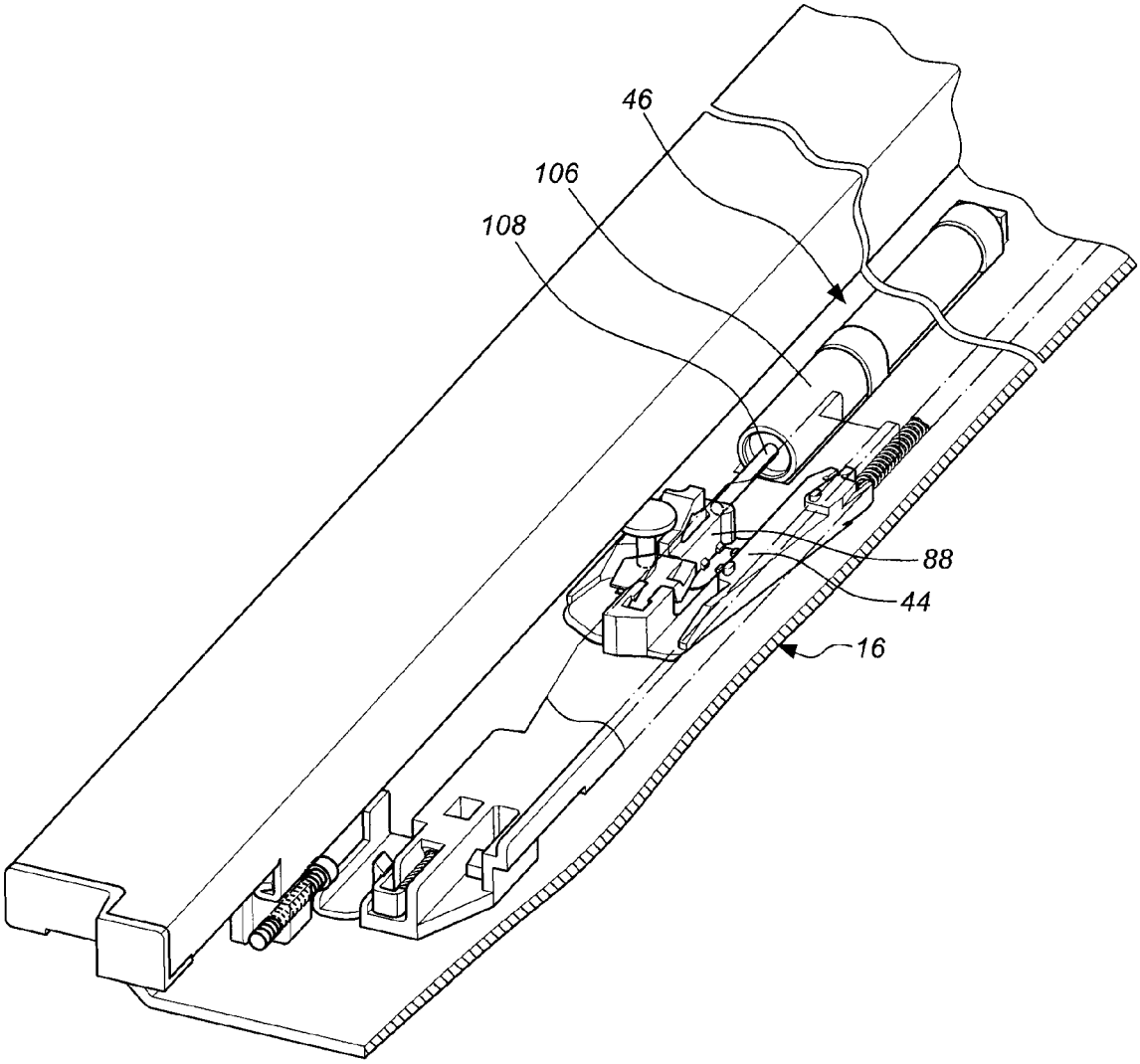
FIG. 24 is a perspective view showing a buffer member according to the first preferred embodiment of the present invention.

As shown in FIG. 24, the present invention further comprises a buffer member 46. The buffer member 46 comprises a buffer cylinder 106 fixed on the stationary part 16 and a telescopic rod 108 which is able to extend linearly with respect to the buffer cylinder 106. The telescopic rod 108 is engaged with the third portion 88 of the slide base 44. When the slide base 44 is moved at a rapid speed, the telescopic rod 108 will disengage from the third portion 88 and then be pushed outwards by the buffer cylinder 106 to engage with the third portion 88 once again for storing a buffer force ahead to act on the slide base 44.

Accordingly, the present invention may be applied on a movable part of a piece of furniture to provide a self-closing and self-opening structure. The stationary part and the movable part may be a cabinet and a drawer, or a stationary rail and a movable rail.

Although the terms and expressions which have been employed and used as terms of description and not of limitation and there is no intention in the use of such terms and expressions of excluding any requirement of the features shown and described, or portions thereof, but it is recognized that various modifications are possible within the scope of the invention claimed.

What is claimed is:

1. A self-moving device for movable furniture parts, comprising:

a stationary part;

a movable part longitudinally slidable with respect to the stationary part and comprising a first connecting portion and a second connecting portion;

a closing mechanism mounted on the stationary part, the closing mechanism comprising a guiding member having a first longitudinal portion and a transverse portion extending from one end of the first longitudinal portion; a slide base connected to the first longitudinal portion and corresponding to the first connecting portion and the second connecting portion; a first elastic member connected to the slide base; a locking member movably connected to the slide base, the locking member and the slide base defining a locking space to accommodate the first connecting portion of the movable part; and a stop portion corresponding to the locking member; wherein the locking member is moved by the stop portion; and an opening mechanism fixed on the stationary part, the opening mechanism comprising a fixed portion; a push member longitudinally movable in the fixed portion, and a second elastic member connected to the push member, the push member being urged by the second elastic member to engage with the second connecting portion of the movable part.

2. The self-moving device according to claim 1, further comprising an elastic piece disposed between the locking member and the slide base.

3. The self-moving device according to claim 1, further comprising a retaining mechanism, the retaining mechanism comprising a retaining member connected to the guiding member and a retaining spring connected between the retaining member and the guiding member, the retaining member being urged by the retaining spring to move longitudinally with respect to the movable part.

4. The self-moving device according to claim 3, further comprising an adjusting mechanism, the adjusting mechanism comprising a base fixed to the movable part and an adjusting member movably connected to the base, the adjusting member engaging with the retaining member.

5. The self-moving device according to claim 1, wherein the guiding member comprises a board portion; a first supporting portion and a second supporting portion disposed at two ends of the board portion to be connected with the stationary part, the first longitudinal portion being disposed between the first supporting portion and the second supporting portion to be connected with the slide base; a second longitudinal portion and a fourth longitudinal portion disposed at two sides of the first longitudinal portion; and a third longitudinal portion disposed in the second longitudinal portion, the first longitudinal portion and the transverse portion being defined by an L-shaped groove, the second longitudinal portion being defined by a longitudinal slot, the third longitudinal portion being defined by a longitudinal groove, the fourth longitudinal portion being defined by a longitudinal wall, the stop portion being disposed at one side of the fourth longitudinal portion.

6. The self-moving device according to claim 1, wherein the stop portion has a guiding surface to guide movement of the locking member and the locking member is movable at an angle to the guiding surface.

7. The self-moving device according to claim 5, wherein the slide base comprises a first portion, a second portion, a third portion, and a body connected to the first portion, the second portion, and the third portion, the first portion comprising a first sliding portion, a second sliding portion, and a third sliding portion which are connected to the first longitudinal portion, the second longitudinal portion, and the third longitudinal portion, respectively, the first sliding portion being a protuberance, the second sliding portion being a bulge, and the third sliding portion being a protuberance.

8. The self-moving device according to claim 1, wherein the slide base comprises a first portion, a second portion, a third portion, and a body connected to the first portion, the second portion, and the third portion, the first portion, the second portion and the body defining a channel to connect with the guiding member, the third portion comprising a first wall, a second wall, and a coupling portion disposed between the first wall and the second wall, the coupling portion extending upwardly and obliquely from the third portion to form an inclined plane thereon, the first wall being adapted to engage with the first connecting portion, the coupling portion being adapted to engage with the second connecting portion.

9. The self-moving device according to claim 1, wherein the slide base comprises a first portion, a second portion, a third portion, and a body connected to the first portion, the second portion, and the third portion, the first portion, the second portion and the body defining a channel to connect with the guiding member, the third portion comprising a first wall, a second wall, a coupling member having a spring room therein, and a third elastic member disposed in the spring room, the coupling member urged by the third elastic member being movable, the coupling member having an inclined plane at an upper end thereof, the first wall being adapted to engage with the first connecting portion, the coupling member being adapted to engage with the second connecting portion.

10. The self-moving device according to claim 1, wherein the stationary part is connected to a cabinet and the movable part is connected to a drawer.

11. The self-moving device according to claim 1, further comprising a buffer member, the buffer member comprising a buffer cylinder and a telescopic rod capable of moving with respect to the buffer cylinder, the telescopic rod extending outwards from the buffer cylinder to engage with the slide base.

12. A self-moving device for movable furniture parts, comprising:

a stationary part;

a movable part longitudinally slidable with respect to the stationary part and comprising a first connecting portion and a second connecting portion;

a closing mechanism comprising a guiding member fixed on the stationary part, the guiding member comprising a first longitudinal portion and a transverse portion, the first longitudinal portion having a first end and a second end opposing to the first end, the transverse portion extending from the first end of the first longitudinal portion; a slide base connected to the first longitudinal portion; a first elastic member connected to the slide base; a locking member movably connected to the slide base, the slide base being urged by the first elastic member to move towards the second end of the first longitudinal portion of the guiding member for the locking member to engage with the first connecting portion of the movable part; and a stop portion corresponding to the locking member for the locking member to lean on the stop portion to move, and an opening mechanism comprising a second elastic member disposed on the stationary part and a push member urged by the second elastic member to move;

wherein when the movable part is retracted to a predetermined position with respect to the stationary part, the first connecting portion of the movable part engages with the locking member and the first connecting portion urged by the first elastic member forces the movable part to be self-closing towards the stationary part;

wherein the locking member is movable in response to an external force to lean on the stop portion such that the first connecting portion of the movable part disengages from the locking member, and the movable part is urged by the second elastic member and pushed by the push member to be self-opening.

13. The self-moving device according to claim 12, further comprising a buffer member, the buffer member comprising a buffer cylinder and a telescopic rod capable of moving with respect to the buffer cylinder, the telescopic rod extending outwards from the buffer cylinder to engage with the slide base.

14. The self-moving device according to claim 12, wherein the guiding member comprises a board portion; a first supporting portion and a second supporting portion disposed at two ends of the board portion to be connected with the stationary part, the first longitudinal portion being disposed between the first supporting portion and the second supporting portion to be connected with the slide base; a second longitudinal portion and a fourth longitudinal portion disposed at two sides of the first longitudinal portion; and a third longitudinal portion disposed in the second longitudinal portion, the first longitudinal portion and the transverse portion being defined by an L-shaped groove, the second longitudinal portion being defined by a longitudinal slot, the third longitudinal portion being defined by a longitudinal groove, the fourth longitudinal portion being defined by a longitudinal wall, and the stop portion being disposed at one side of the fourth longitudinal portion.

15. The self-moving device according to claim 12, wherein the stop portion has a guiding surface to guide movement of the locking member and the locking member is movable at an angle to the guiding surface.

16. A self-moving device for movable furniture parts, comprising:

a stationary part;

a movable part longitudinally slidable with respect to the stationary part;

a first elastic member disposed on the stationary part;

a closing mechanism mounted on the stationary part and comprising a slide base and a locking member connected to the slide base, the slide base being urged by the first elastic member to slide for the locking member to engage with the movable part;

a second elastic member disposed on the stationary part, the movable part urged by the second elastic member to generate an open force with respect to the stationary part, and a retaining spring disposed on the stationary part, and a retaining member urged by the retaining spring to move longitudinally with respect to the movable part;

wherein the movable part comprises a first connecting portion; the locking member and the slide base being urged by the first elastic member to engage with the first connecting portion of the movable part.

17. The self-moving device according to claim 16, further comprising a guiding member fixed on the stationary part, the retaining member being longitudinally movable in the guiding member, the slide base being movably connected to the guiding member to move.

18. The self-moving device according to claim 16, further comprising a retaining seat fixed on the stationary part, the retaining member being longitudinally movable in the retaining seat.

19. The self-moving device according to claim 16, further comprising an adjusting mechanism, the adjusting mechanism comprising a base fixed to the movable part and an adjusting member movably connected to the base, the adjusting member engaging with the retaining member for the movable part to be adjusted with respect to the stationary part.

* * * * *